US005604573A

United States Patent [19]

Endo et al.

[11] Patent Number: 5,604,573

[45] Date of Patent: Feb. 18, 1997

[54] DEVELOPING UNIT WITH A SMOOTHING PLATE

[75] Inventors: Isao Endo; Satoshi Haneda; Yotaro Sato; Hiroyuki Nomori, all of Hachioji, Japan

[73] Assignee: Konica Corporation, Tokyo, Japan

[21] Appl. No.: 331,390

[22] Filed: Oct. 28, 1994

[30] Foreign Application Priority Data

Nov. 5, 1993 [JP] Japan ..... 5-277010
Jun. 3, 1994 [JP] Japan ..... 6-122646

[51] Int. Cl.[6] ..... G03G 15/06; G03G 15/09

[52] U.S. Cl. ..... 399/55; 399/222; 399/267; 399/272

[58] Field of Search ..... 355/247, 245, 355/251, 253, 261–265, 246, 219; 118/647, 654, 657, 658

[56] References Cited

U.S. PATENT DOCUMENTS

| | | | |
|---|---|---|---|
| 4,266,503 | 5/1981 | Uehara et al. | 118/657 |
| 4,804,994 | 2/1989 | Sasaki et al. | 118/657 X |
| 4,841,332 | 6/1989 | Haneda et al. | 355/251 |
| 4,844,008 | 7/1989 | Sakemi et al. | 355/253 X |
| 4,887,131 | 12/1989 | Kinoshita et al. | 355/253 |
| 5,157,226 | 10/1992 | Takahashi | 118/654 X |
| 5,360,940 | 11/1994 | Hays | 118/654 |
| 5,428,428 | 6/1995 | Haneda | 355/246 |
| 5,473,416 | 12/1995 | Endou et al. | 355/246 |

FOREIGN PATENT DOCUMENTS

| | | | |
|---|---|---|---|
| 0214053 | 12/1984 | Japan | 355/261 |
| 0052667 | 3/1986 | Japan | 355/261 |
| 0122960 | 4/1992 | Japan | 355/261 |
| 0011542 | 1/1993 | Japan | 355/261 |
| 0175485 | 6/1994 | Japan | 355/261 |

OTHER PUBLICATIONS

Patent Abstracts of Japan, vol. 007, No. 078 (P–188), 31 Mar., 1983 and JP–A–58–007165 (Canon KK), 14 Jan., 1983.

Patent Abstracts of Japan, vol. 105, No. 347 (P–1246), 3 Sep., 1991 and JP–A–03–131879 (Canon Inc.), 5 Jun., 1991.

Patent Abstracts of Japan, vol. 010, No. 097 (P–446), 15 Apr., 1986 and JP–A–60–230175 (Ricoh KK), 15 Nov. 1985.

Patent Abstracts of Japan, vol. 004, No. 149 (P–032), 21 Oct. 1980 and JP–A–55–096969 (Ricoh Co. Ltd.), 23 Jul., 1980.

*Primary Examiner*—Matthew S. Smith
*Attorney, Agent, or Firm*—Frishauf, Holtz, Goodman, Langer & Chick

[57] ABSTRACT

A developing apparatus for developing an electrostatic latent image on an image retainer with two-component developer has a rotatable sleeve having a closest position on which the sleeve comes closest to the image retainer, a first magnet fixed in the sleeve in close proximity to the closest position, a second magnet disposed upstream of the first magnet in relation to a rotation direction of the sleeve and a control electrode member. The control electrode member includes an insulating plate member arranged either to be brought into contact with or to be positioned adjacent to the sleeve and a line-shaped electrode member fixed to the plate member.

18 Claims, 18 Drawing Sheets

FIG.22(a)
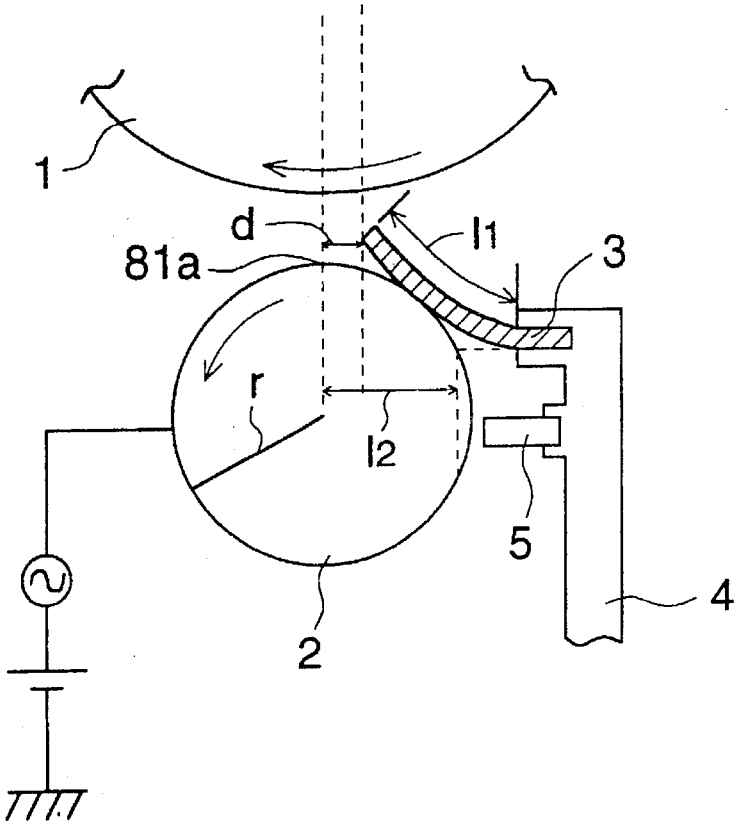
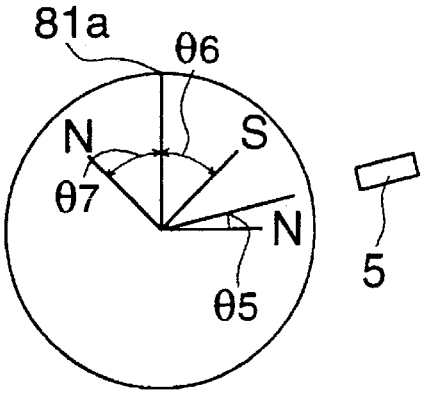
FIG.22(b)

FIG.23(a)
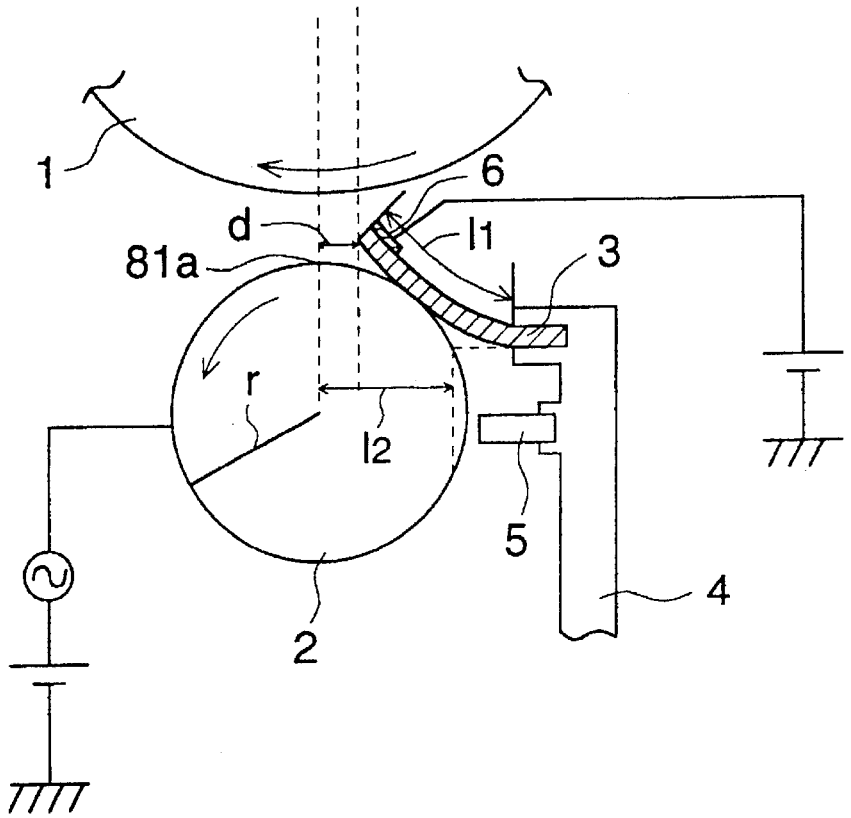
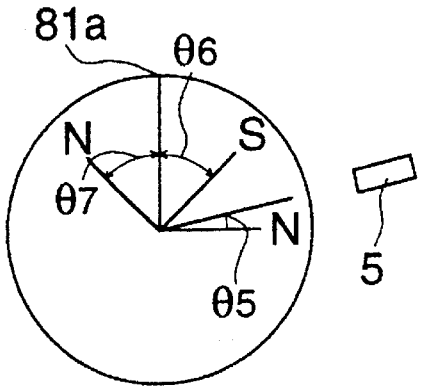
FIG.23(b)

FIG.24(a)
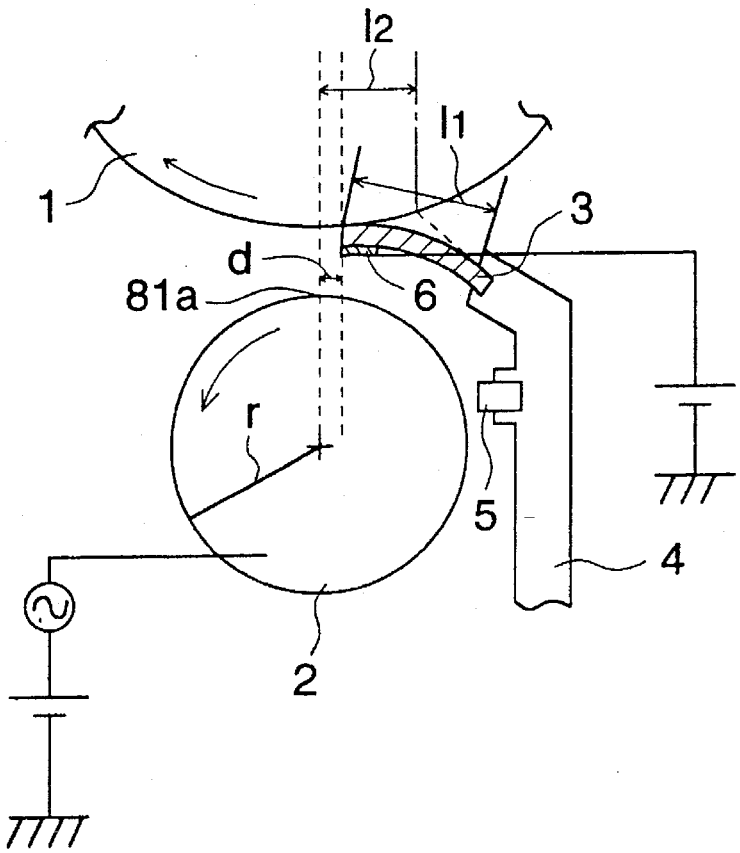
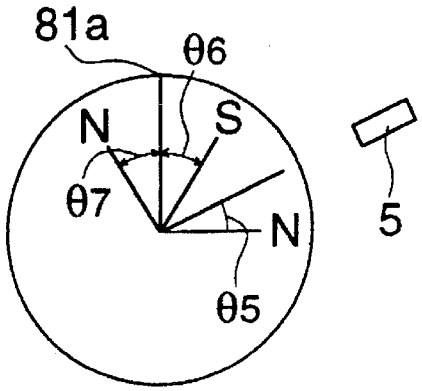
FIG.24(b)

DEVELOPING UNIT WITH A SMOOTHING PLATE

BACKGROUND OF THE INVENTION

The present invention relates to a developing unit for developing an electrostatic latent image or a magnetic latent image using a two-component developer in which magnetic carrier particles and toner particles are mixed, in an electrophotographic copier, and the like.

Conventionally, in an electrophotographic copier, a magnetic brush development type developing unit using a two-component developer, is used. This developing unit has a cylindrical developing sleeve and a magnet roller composed of a magnet body having a plurality of magnetic poles therein, and which is rotatably supported. Magnetic carriers, to which toner particles are adhered, are held on the surface of the developing sleeve, and conveyed to a developing area for development. This developing unit has the following features: control of triboelectricity of the toner particle is relatively easy; coagulation of toner particles rarely occurs; bristling of the magnetic brush is good; the frictional property of the surface of an image carrier is superior; and when the developing unit is also operated for cleaning, the cleaning effect is very satisfactory. Although, in this type of developing unit, control of the amount of toner with respect to that of the carrier particles is necessary, this type of developing unit is used very often. However, in the developing method in which this magnetic brush is rubbed on the surface of the image carrier for development, conventionally, the developer composed of the magnetic carrier particles having an average diameter in multiples of ten μm through multiples of hundred μm and the non-magnetic carrier having an average diameter of about 10 μm is used. Since the diameter of toner particles and carrier particles is large, problems exist in which a high quality image for reproducing fine lines or dots, or the difference of densities, can hardly be obtained. In order to obtain the high image quality, conventionally, many technologies such as, for example, resin coating of the carrier particle, and improvements in the magnet body in the developer conveyance body, have been used. However, stable and satisfactory images can not yet be obtained. Accordingly, in order to obtain higher quality images, the following has been considered that it is necessary to make the diameter of toner and carrier particles smaller. However, when the toner particles are reduced to an average particle size of not more than 20 μm, particularly not more than 10 μm, the following difficulties occur: ① the influence of Van der Waals forces appear relative to the Coulomb force at the time of development; the adhesive force between the image forming body and toner becomes strong; so-called fogging in which toner particles adhere to a background portion of the image, occurs; and it is difficult to prevent fogging even when a DC bias voltage is impressed upon a developer conveyance body. ② Triboelectricity control of toner particles becomes difficult, and coagulation easily occurs. On the other hand, as carrier particles are made finer, ③ carrier particles adhere to an electrostatic image portion of the image carrier. As a reason for this phenomenon, the following can be considered: the force of magnetic bias is lowered, and carrier and toner particles adhere to the image carrier side. When the bias voltage becomes larger, carrier particles also adhere to the background portion of the image. When particles are made finer, there are problems in which the above-described side effect becomes more conspicuous, and a sharp image can not be obtained. Accordingly, when toner and carrier particles are made finer, difficulties occur in the actual use of the finer particles.

In order to solve the above-described problems, the following methods have been proposed: ① a method in which the deevloper is conveyed to a developing area in such a manner that the developer is not in contact with the image forming body, toner in the developer is scattered by an oscillation electric field, and the latent image is developed (Japanese Patent Publication Open to Public Inspection No. 222847/1984); and ② a method in which, in a non-contact developing method, a horizontal magnetic field is formed on the developing area, a smoothing member is provided between the central portion of the developer area and a regulation member for regulating the layer thickness of the developer layer, and a DC bias voltage having a reverse polarity to the charging polarity of toner particles is impressed upon the smoothing member (Japanese Patent Publication Open to Public Inspection No. 94368/1989).

Further, ③ a toner cloud developing method using a plate-shaped electrode body (Japanese Patent Publication Open to Public Inspection No. 131879/1991) has been disclosed.

However, the above-described method ①, the following problems occur: when the average particle size of toner particles is not more than 10 μm, since the influence of the Van der Waals forces becoms large as previously described, the adhesive force between carrier and toner is increased, so that the developability is lowered extremely.

In the above-described method ②, there are the following problems: bristles of the magnetic brush collapse due to the horizontal magnetic field, so that the developer layer is made denser; accordingly, toner is barely extracted by the smoothing member; and especially, when small-sized toner particles having an average particle size of not more than 10 μm are used, the developability is extremely lowered. Further, since a DC voltage having the reverse polarity to that of toner is impressed upon the smoothing member, toner particles are accumulated during the progress of the devloping operation and the image is stained.

Further, in the above-described method ③, there is a problem in which: since the electrode body is the plate-shaped member, the toner cloud is generated at the contact position of the electrode body or even on the upstream portion of the closest-position of the electrode body, and the amount of developer conveyed is lowered, so that development can not be correctly carried out.

The first object of the present invention is to provide a developing unit by which an image is not stained, and stable and high developability can be obtained even when smaller toner particles and carrier particles are used, by the method in which where toner particles in the developer are made to fly by the oscillation electric field after a two-component developer has been smoothed by a plate-shaped member.

The second object of the present invention is to form a high density and uniform developer layer on the developer conveyance body when a plate-shaped elastic body is located in such a manner that it is used as a smoothing member, and is pressed on the developer on the developer conveyance body. This technology to attain the second object can be used for a general contact type development method, and can be effectively used, especially for the non-contact type development method.

SUMMARY OF THE INVEVNTION

The above-described first objective can be attained by a developing unit in which a two-component developer is conveyed to a developing area by a rotating developing sleeve inside of which a magnet body having a plurality of magnet poles are fixed, and toner is scattered in an oscillation electric field so that a latent image formed on an image forming body is developed, the developing unit is characterized in that: a main magnet pole of the magnet body is located near the closest position between the developing sleeve and the image forming body in the developing area; the developing unit is provided with a control electrode member which comprises an insulation plate-shaped member and a line-shaped electrode, wherein the insulation plate-shaped member which is in contact with a magnet brush or is close to the magnet brush formed by the magnet pole of the magnet body is located on the upstream side of the main magnet pole; and the line-shaped electrode, upon which a voltage can be impressed, is located at an end of the developing area side of the plate-shaped member.

Further, the end of the line-shaped electrode is located in the range of the magnetic flux density of 0.2 Hr through 1 Hr at the upstream portion of the main magnat pole when the maximum flux density of the main magnet pole is Hr. When the angle between the closest positon of the developing sleeve to the image forming body and the main magnet pole is defined as θ1, an angle between the main magnet pole and the end of the line-shaped electrode is defined as θ2, and an angle between the main magnet pole and the upstream slide magnet pole adjoining the main magnet pole is defined as θ3 around the rotational shaft of the developing sleeve, then $\theta_1=-10°$ through $10°$ $\theta_2=(0 \text{ through } 0.5)\times\theta_3$ $\theta_3=-10°$ through $-45°$ Further, a preferred embodiment is that: the developing unit is characterized in that: a bias voltage, in which an AC voltage is superimposed on a DC voltage, is impressed upon the developing sleeve; and a DC bias voltage is impressed upon the line-shaped electrode.

The second object of the present invetion can be attained by a developer smoothing member for a developing unit made of resins reinforced with inorganic fibers or organic fibers, which is provided to be in pressure-contact with a developing agent on a developer conveyance body at the developing area surrounded by an image forming body and by a developer conveyance body which faces the image forming body or at the position located on the upstream side of the developer conveyance body in the developer conveyance direction. The object of the invention mentioned above can be achieved by this developer smoothing member.

BRIEF DESCRIPTION OF THE DRAWINGS

FIG. 1(*c*) is a schematic diagram showing a circuit to supply a bias voltage.

FIGS. 22(*a*) and 22(*b*) are views showing an embodiment of the present invention.

FIGS. 23(*a*) and 23(*b*) are views showing an embodiment of the present invention.

FIGS. 24(*a*) and 24(*b*) are views showing an embodiment of the present invention.

DETAILED DESCRIPTION OF THE PREFERRED EMBODIMENT

Figure 2:
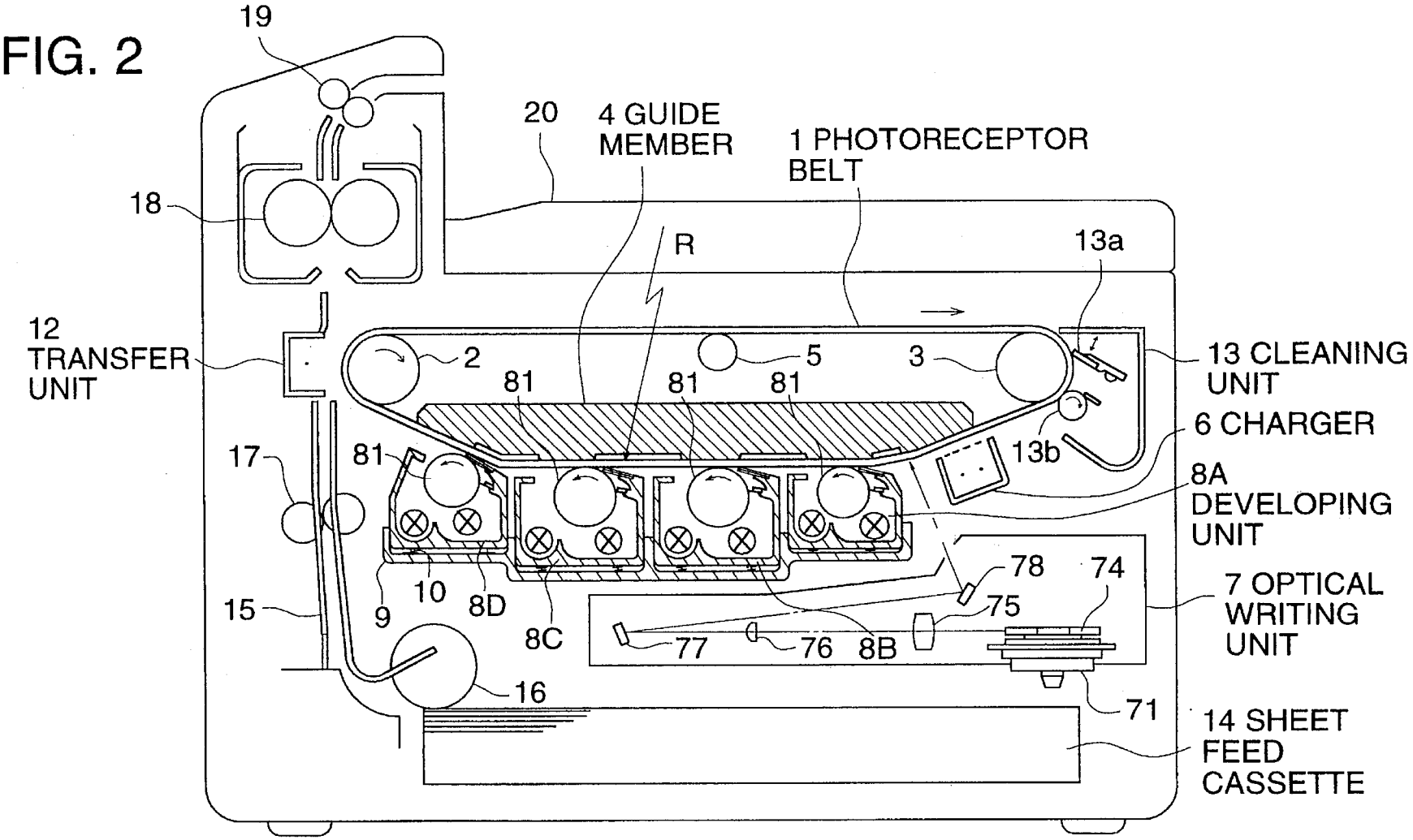
FIG. 2 is a sectional view showing one example of a color image forming apparatus provided with the developing unit of the present invention.

FIG. 2 is a view showing the sectional structure of an example of a color image forming apparatus with which developing units of the present invention are provided as preferable developing units.

In FIG. 2, numeral 1 is a belt-shaped photoreceptor which is composed of a flexible belt on which light conductive material is coated or vapor-deposited. This photoreceptor belt 1 is stretched between rotating rollers 2 and 3, and conveyed clockwise when the rotating roller 2 is driven.

Numeral 4 is a guide member fixed to the apparatus main body so that the guide member 4 inscribes the photoreceptor belt 1. When the photoreceptor belt 1 is tensioned by the tension roller 5, the guide member 4 slides on the inner peripheral surface of the photoreceptor belt 1.

Numeral 6 is a scorotron charger which is a charging means. Numeral 7 is an optical writing means using a laser beam which is an image exposure means. Numerals 8A through 8D are developing units in which developer of specific colors are accommodated respectively, and which are a plurality of developing means according to the present invention. These image forming means are respectively provided at a portion on which the photoreceptor belt 1 comes into contact with the guide member 4.

The developing units 8A, 8B, 8C, and 8D, which will be described in detail later, accommodate respectively, for example, yellow, magenta, cyan and black developers, and are respectively provided with developing sleeve 81 each of which maintains a predetermined gap to the photoreceptor belt 1. The developing units function to visualize a latent image formed on the photoreceptor belt 1 by a non-contact reversal developing method. This non-contact developing method, which is different from a contact developing method, has the advantage that it does not disturb the movement of the photoreceptor belt 1.

Numeral 12 is a transfer unit. Numeral 13 is a cleaning unit, and its blade 13*a* and toner delivery roller 13*b* are kept separate from the photoreceptor belt 1 surface during image formation. They are pressure-contacted with the photoreceptor belt 1 surface only at the time of cleaning after the image has been transferred.

In the image forming apparatus, the color image forming process is carried out as follows.

Figure 6:
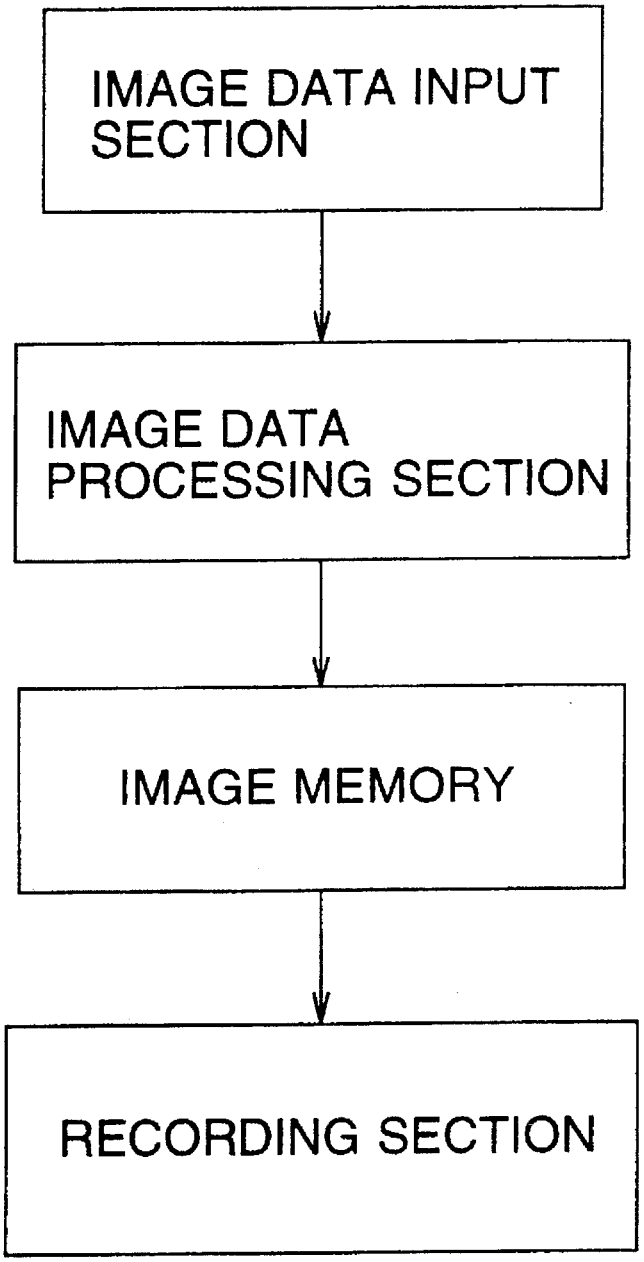
FIG. 6 is a block diagram showing an image forming system.

Initially, the multi-color image formation in this example is carried out according to the image forming system shown in FIG. 6. That is, original image data is obtained in a color image data input section in which an image pick up element scans the original image; this data is arithmetic-processed in an image data processing section and image data is produced; and the image data is temporarily stored in an image memory. Next, this image data is read out at the time of recording and inputted into a color image forming apparatus which is a recording section, for example, as shown in FIG. 2. That is, image data, which is a color signal outputted from an image reading apparatus separately provided from the color image forming apparatus, is inputted into the optical writing unit 7. At this time, in the optical writing unit 7, a laser beam (writing light beam) generated from a semiconductor laser (not shown) which is a light source for a writing light beam, passes through a collimator lens and a cylindrical lens (not shown) and is rotationally scanned by a rotational polygonal mirror 74 rotated by a driving motor 71; the laser beam passes through an fθ lens 75 and a cylindrical lens 76 during which the optical path of the laser beam is bent by two mirrors 77 and 78; the laser beam is then projected onto the peripheral surface of the photoreceptor belt 1 which is uniformly charged previously by a scorotron charger 6 which is a charging means, and primary scanning is carried out so that a bright line is formed.

On the other hand, when scanning is started, the laser beam is detected by an index sensor (not shown) and a laser beam modulated by the first color signal scans the peripheral surface of the photoreceptor belt 1. Accordingly, a latent image is formed corresponding to the first color on the peripheral surface of the photoreceptor belt 1 by primary scanning by the laser beam and by subsidiary scanning by the conveyance of the photoreceptor belt 1. This latent image is developed by a developing unit 8A of the developing means in which yellow (Y) toner (visualizing medium) is accommodated, and a toner image is formed on the belt surface. The toner image formed due to the above-described process passes under a blade 13*a* and a toner discharging roller 13*b* of a cleaning unit 13, which is a cleaning means and is separated from the peripheral surface of the photoreceptor belt 1, while being held on the belt surface, and the process enters into the next image formation cycle.

That is, the photoreceptor belt 1 is charged again by the charger 6, then the second color signal is inputted into the optical writing unit 7, and is written onto the belt surface in the same manner as in the first color signal so that a latent image is formed. This latent image is developed by a developing unit 8B in which magenta (M) toner is accommodated as the second color.

This magenta (M) toner image is formed under the existence of the yellow (Y) toner image which has been previously formed.

Numeral 8C is a developing unit in which cyan (C) toner is accommodated, and a cyan toner image is formed on the belt surface in the same manner as in the first and second colors.

Numeral 8D is a developing unit in which black toner is accommodated, and a black toner image is formed being superimposed on the belt surface by the same processing as in the previous colors. DC bias voltage and further AC bias voltage are impressed upon developing sleeves 81 of developing units 8A, 8B, 8C and 8D; non-contact development is carried out by a two-component developer which is a visualizing means, and the development is carried out without contact with the photoreceptor belt 1, the base body of which is grounded.

High voltage, the polarity of which is reverse to that of the toner, is impressed upon the color toner image thus formed on the peripheral surface of the photoreceptor belt 1 in a transfer section, and the toner image is transferred onto a transfer sheet conveyed from a sheet feed cassette 14 through a sheet feed guide 15.

That is, the uppermost sheet of the transfer sheet accommodated in the sheet feed cassette 14 is conveyed out by rotation of the sheet feed roller 16, and is fed to a transfer unit 12 in timed relation with image formation on the photoreceptor belt 1 through a timing roller 17.

The transfer sheet on which the toner image is transferred, is conveyed upward after the transfer sheet has been positively separated from the photoreceptor belt 1, the direction of which is suddenly turned along the driven roller 2. After the toner image has been fused and fixed by a fixing roller 18, the transfer sheet is delivered onto a tray 20 through a sheet delivery roller 19.

On the other hand, the photoreceptor belt 1, from which the toner image has been transferred onto the transfer sheet, continues conveying. By the cleaning unit 13 in which the blade 13*a* and the toner discharging roller 13*b* are pressure-contacted with the photoreceptor belt 1, residual toner is removed. Just after the toner has been removed, the blade 13*a* is separated again from the photoreceptor belt 1, and a little later, the toner discharging roller 13*b* is separated from the photoreceptor belt 1. Then, the photoreceptor belt 1 enters into a new image formation process.

As the color image forming apparatus using the developing unit according to the present invention, the belt-shaped image forming body has been described here, however, an image forming apparatus having a drum-shaped image forming body may be used in the same manner.

Figure 1:
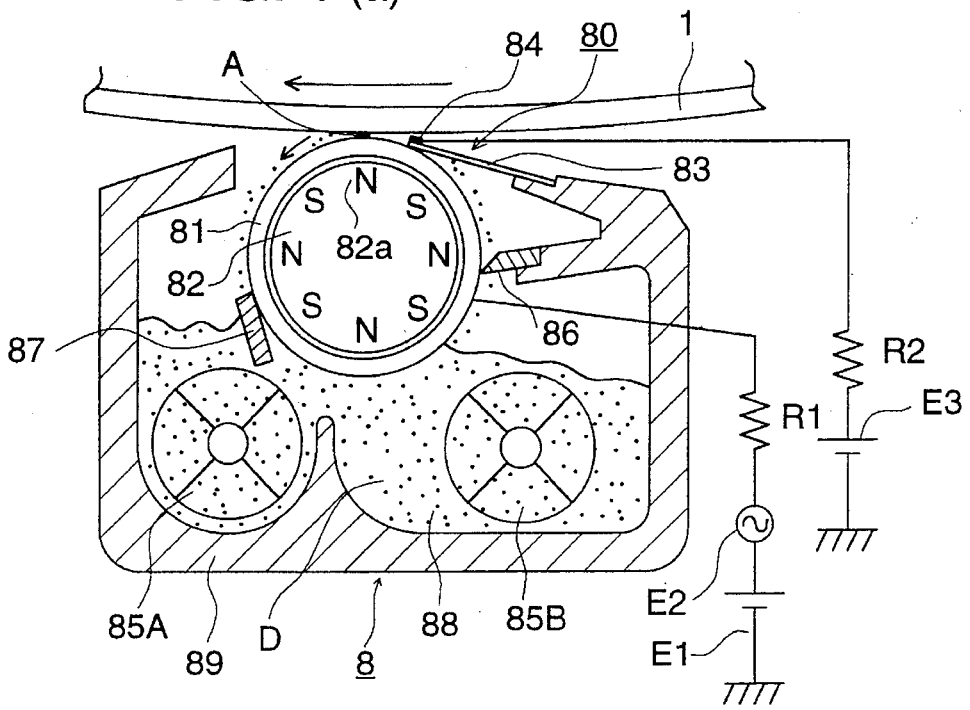
FIGS. 1(*a*) and 1(*b*) are sectional views showing an example of a developing unit which can attain the first object of the present invention.
Figure 1:
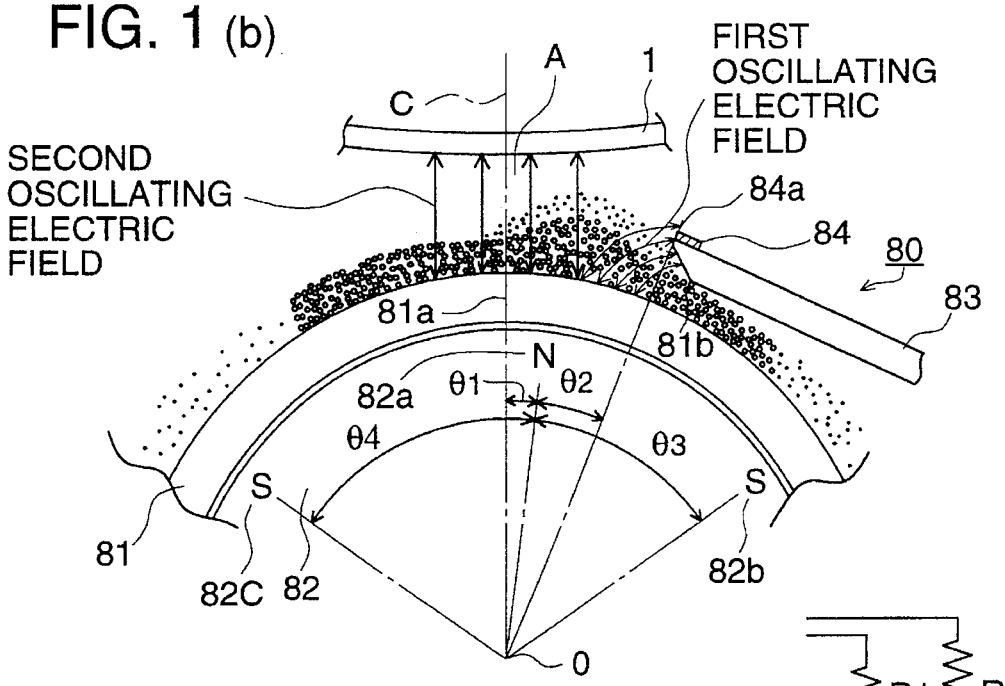
Figure 1:
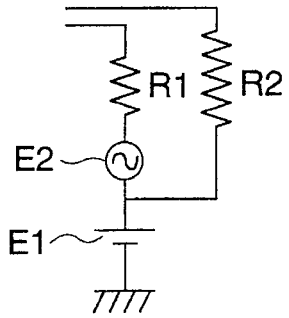

The developing units 8A through 8D have the same structure, and they will be shown hereinafter by the numeral 8. FIG. 1 is a sectional view showing an outline of an example of the developing unit according to the present invention. FIG. 1(*a*) is a sectional view of an example of the unit of the present invention. In the drawing, numeral 81 is a developing sleeve made of non-magnetic material such as aluminum or the like. Numeral 82 is a magnet body which is fixed inside the developing sleeve 81, and has a plurality of paired magnet poles of N and S on its surface in the direction of the periphery thereof. One of the magnet poles is located in the vicinity of the position at which the developing sleeve 81 is most closely contacted with the photoreceptor belt (an image forming body) 1, and the pole will be called a main magnet pole hereinafter. The developing sleeve 81 and the magnet body 82 structure comprises a developer conveyance body. The developing sleeve 81 can be rotated with respect to the magnet body 82. FIG. 1(*a*) shows that the developing sleeve 81 rotates in the left direction as shown by an arrow, and the magnet body 82 is fixed. The main pole 82*a* of the magnet body 82 and other magnetic poles of N and S are normally magnetized with magnetic flux density of 500 through 1500 gauss, and a magnetic brush, which is formed by a layer of developer D of toner particles and carrier particles, is formed on the surface of the developing sleeve 81 by the magnetic force of the magnet body 82. This magnetic brush moves in the same direction as that of the rotation of the developing sleeve 81 when the developing sleeve 81 is rotated, and is conveyed to a developing area A. A gap between the developing sleeve 81 and a regulation blade 86, and a gap between the developing sleeve 81 and the photoreceptor belt 1 are adjusted so that the magnetic brush formed on the developing sleeve 81 is not in contact with the surface of the photoreceptor belt 1 and the gap is maintained between the magnetic brush and the surface of the photoreceptor belt 1.

Numeral 83 is a plate-shaped member, which is also used as a smoothing member, made of an electric insulating body such as, for example, polyester, polyimide, glass epoxy, polyethyrene terephthalate, polyamide imide, etc. Numeral 84 is a linear electrode member made of conductive material such as metal which is integrally provided with the plate-shaped member 83 linearly on an end portion of the plate-shaped member 83 in order to form an oscillating electric field on the end portion on the plate-shaped member 83. A control electrode member 80 comprises of the plate-shaped member 83 and the linear (line-shaped) electrode member 84. Numerals 85A and 85B are stirring screws which make components uniform by stirring the developer D. Numeral 86 is a regulating blade, made of a non-magnetic body or a magnetic body, which is provided for regulating the height and the amount of the magnetic brush. Numeral 87 is a cleaning blade for removing the magnetic brush, which has passed the developing area A, from the developing sleeve 81. Numeral 88 is a developer reservoir, and numeral 89 is a casing.

Figure 3:
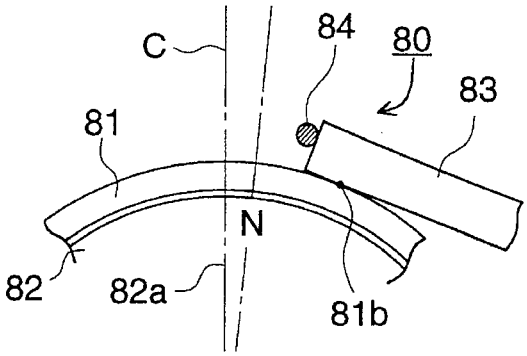
FIGS. 3(*a*) through 3(*j*) are sectional views showing another example of a plate-shaped member and a line-shaped electrode shown in FIG. 1.
Figure 3:
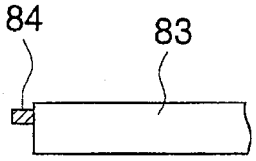
Figure 3:
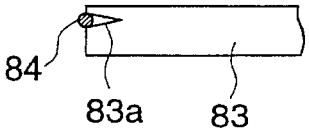
Figure 3:
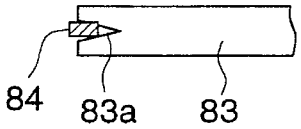
Figure 3:
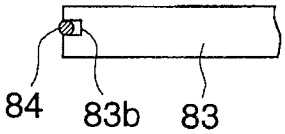
Figure 3:
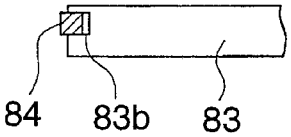
Figure 3:
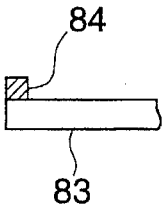
Figure 3:
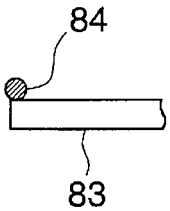
Figure 3:
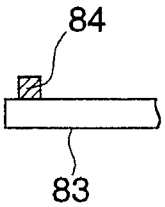
Figure 3:
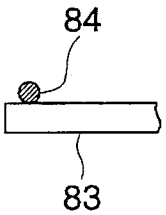
Figure 4:
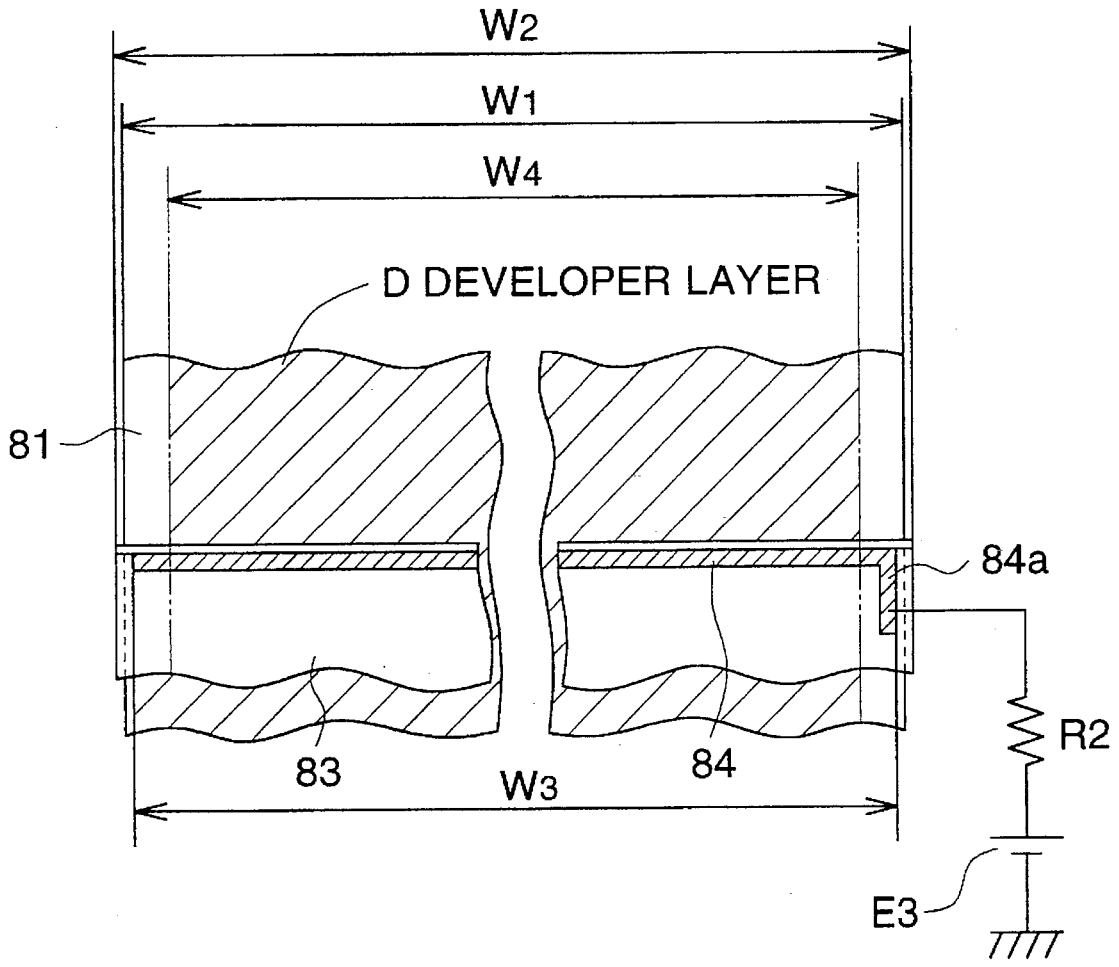
FIG. 4 is a plan view showing another example of the line-shaped electrode shown in FIG. 1.

As shown in FIG. 3, the linear electrode member 84 is formed by the following methods on the end of the plate-shaped member 83: a linear metallic conductive material or the like, the cross section of which is circular or rectangular, is adhered onto the end portion of the insulating plate-like member 83 (FIGS. 3(*a*), 3(*b*), 3(*g*), 3(*h*)); a cutout 83*a* is provided on the end portion of the plate-shaped member 83 and the linear electrode is inserted into the cutout 83*a* (FIGS. 3(*c*), 3(*d*)); a recess 83*b* is provided at the end portion of the plate-like member 83, and is embedded therein (FIGS. 3(*e*), 3(*f*)); and further, as shown in FIG. 4, after conductive material such as copper foil, etc. has been laminated onto the plate-shaped member 83 made of glass epoxy, polyimide, or paper phenol, the member is etched using a conventional printed circuit board manufacturing method. The linear electrode member 84 may be coated with insulating resin in order to prevent undesirable discharging and rusting. The above-described examples (FIGS. 3(*a*) through 3(*h*)) in which the linear electrode member 84 is located at the end of the plate-shaped member 83 are superior for developability. When the linear electrode member 84 is located inside the end of the plate-shaped member 83, and separated from the end of the plate-shaped member, as shown in FIGS. 3(*i*) and 3(*j*), it is superior for preventing toners from adhering to the linear electrode member 84.

In this case, as shown in FIG. 3(*a*), the linear electrode member 84 on the control electrode member 80 is formed only at the downstream side in the direction of the rotation of the developing sleeve, apart from the closest contact point 81*b* at which the plate-like member 83 is in contact with the developing sleeve 81 in order to prevent generation of undesirable clouding at the conveyance upstream portion, and to obtain a stable conveyed amount. The length of the linear electrode member 84 in the direction of the periphery of the developing sleeve 81 is preferably 0.05 mm through 5 mm, specifically 0.1 through 1 mm, depending on the diameter and conveyance speed of the developing sleeve 81. When the length is less than 0.05 mm, a sufficient cloud can not be generated, and when the length is more than 5 mm, toner is excessively charged by oscillation, so that developability is lowered. When the closest contact distance between the image forming body 1 and developing sleeve 81 in the developing area is defined as g, then the thickness of the linear electrode member 84 is preferably (⅔)g through (1/10000)g, and specifically (½)g through (1/1000)g. When the thickness is more than (⅔)g, a gap between the image forming body 1 and the linear electrode member 84 is narrower, so that the linear electrode member 84 more easily comes into contact with the surface of the image forming body 1, and disturbance of the image occurs more easily. On the contrary, when the thickness is less than (1/10000)g, current flows easily from the developing sleeve 81 and the voltage drops, so that the developability is lowered. The plate-shaped member 83 is selected so that it can support the linear electrode member 84 in such a manner that the upper end portion of the linear electrode member 84 on the image forming body side is located at a portion which is apart from the upper end of the plate-shaped member 83 by the distance smaller than (⅔)g; and the lower end portion of the electrode 84 on the developing sleeve side is located at a portion which is apart from the lower end of the plate-shaped member 83 by a distance larger than (1/10000)g. However, from the view point of strength, oscillation prevention, and prevention of contact with the image forming body 1, the plate-shaped member 83 having the above-described distance of (⅔)g through (1/100)g is preferable. When the length of the linear electrode member 84 is $w_3$, and the width of the developer D layer on the developing sleeve 81 is $w_4$, then $w_3>w_4$. A terminal portion 81*a*, from which DC voltage $E_3$ is impressed upon the linear electrode member 84, is provided at a portion outside a $w_4$ area on the linear electrode member 84, and thereby the generation of unnecessary clouding is prevented.

Figure 5:
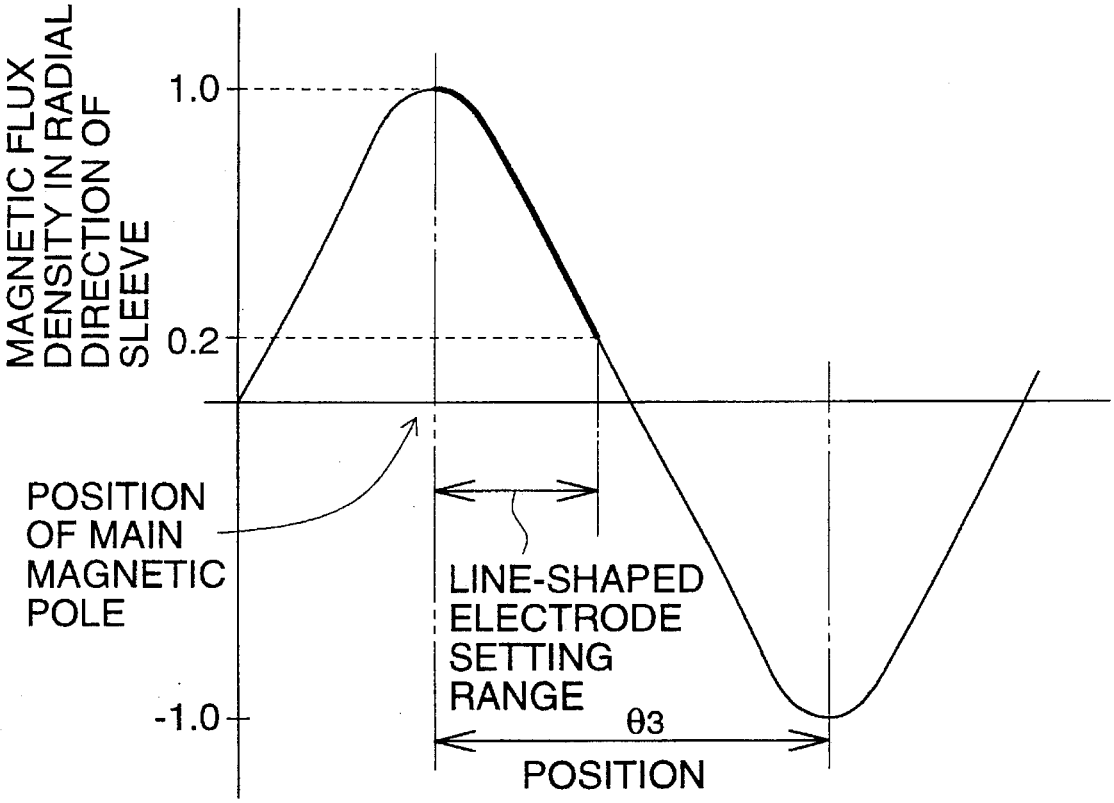
FIG. 5 is a graph showing a preferable range of a magnetic flux density on an end portion of the line-shaped electrode shown in FIG. 1.

As shown in FIG. 1(*b*), FIG. 3(*a*) and FIG. 5, the linear electrode member 84 on the control electrode member 80 is located only between the main magnetic pole 82*a* and a contact point or the closest contact point 81*b* of the plate-shaped member 83 with the developing sleeve 81. The linear electrode member 84 is located right above on upstream of the main magnetic pole 82*a* with respect to the rotation of the developing sleeve 81, and in the range in which the magnetic flux density is 0.2 Hr through 1 Hr when the maximum magnetic flux density in the radial direction of the developing sleeve 81 due to the main magnetic pole 82*a* is defined as Hr. This is for the following reason: at a portion in which the magnetic flux density is less than 0.2 Hr, the magnetic constraining force is insufficient, so that the toner is easily scattered and the image is easily fogged. The magnetic flux density can be measured by a usual gaus meter.

From the result of the experiment, the following were found: when the center line C is defined as a straight line which connects the closest contact position 81*a* between the developing sleeve 81 and the photoreceptor belt 1, to the rotation shaft O of the developing sleeve 81; an angle between the center line C and the main magnet pole 82*a*, that is, the angle between the closest contact position 81*a* and the main magnet pole 82*a*, with the rotation shaft O of the developing sleeve 81 as the center, is defined as $\theta_1$; the angle between the main magnet pole 82*a* and the end portion of the control electrode member 80 is defined as $\theta_2$; and the angle between the main magnet pole 82*a* and a magnet pole 82*b* adjoining the main magnet pole 82*a* on the upstream side thereof is defined as $\theta_3$ (the sign of the angle is + on the upstream side of the center line C, and – on the downstream side of the center line C), then, $\theta_1$=–10° through 10°, $\theta_3$=10° through 45°

$\theta_2$=(0 through 0.5)×$\theta_3$ $\theta_4$–10° through –45°

The above relationships were found to be preferable for the following reasons: bristling of developer D in the developing area A is good; high developing efficiency is maintained; and scattering of toner is prevented.

That is, when the angle with respect to the center line C of the main magnet pole 82*a* is more than ±10°, bristling of developer D in the developing area A is bad.

When the angle $\theta_2$ between the end of the control electrode member 80 and the main magnet pole 82 is smaller than 0°, bristling of developer D is prevented and the developing efficiency is rarely improved. When $\theta_2$ is larger than 0.5×$\theta_3$, the bristle of developer D collapses and the bristle becomes dense, and it is difficult to move the toner to the surface of the image forming body, so that developability is lowered. Further, Since bristling of the devloper is not controled in the developing area, the developer is unnecessarily in contact with the image forming body, so that fogging or image whitening occurs. Here, when $\theta_2$ is in the range of (0 through 0.3)×$\theta_3$, more preferable results were obtained.

When angles $\theta_3$ and $\theta_4$ between the main magnet pole 82*a*, and magnet poles 82*b* and 82*c* which are each adjoining the main magnet pole 82*a*, are outside of the range of 10° through 45° , bristling of developer D is not uniform. Further, stable bristling of the developer and a stable conveyance amount of the developer can not be obtained.

In the above-described prior art (Japanese Patent Publicaiton Open to Public Inspection No. 94368/1989), magnets were arranged on the upstream and downstream sides of the closest position of the devloping sleeve to the photorecptor at approximately equal angles and a horizontal magnetic field was formed. In the present invention, a main magnet pole is arranged at the closest position of the developing sleeve to the photoreceptor, and the plate-shaped member is arranged so that it is in contact with the magnetic brush formed between the main magnet pole and the magnet arranged at the upstream side. Further, the entire body of the line-shaped electrode member of the control electrode member is arranged on the plate-shaped member of the control electrode member on the downstream side of the contact point of the plate-shaped member with the magnet brush.

As described in the prior art, when the horizontal magnetic field is formed in the devloping area, the bristle of the magnetic brush is collapsed and toner is hardly made to fly.

In the present invention, since the main magnet pole is arranged near the closest contact position, specifically at a position in which an angle $\theta_1$ around the center line of the main magnet pole is $-10°<\theta_1<10°$, especially $15°<\theta_1<5°$, carrier particles are rolled by the magnetic force of the main magnet pole, and not only toner particles adhered onto the upper surface (the photoreceptor side) of the carrier particles, but also the toner particles adhered onto the bottom surface of the carrier particles can be used for development. Further, excellent bristling of the developer can be obtained, and the density of the developer is appropriately reduced in the developer area, so that the developer on the lower layer can also be used for development. By the above effects, the high development efficiency can be obtained.

The main magnet pole is preferably arranged on the upstream side (+ side) of the center line in the above-described range. This reason is as follows: the developer passes over the main magnet pole, so that the developer becomes sufficiently loose, and higher development efficiency can be obtained.

A bias voltage, in which AC component is superimposed on DC component, is impressed upon the developing sleeve 81 from a DC bias power source E1 and an AC bias power source E2 through a protective resistor R1. Further, a bias voltage composed of only DC component is impressed upon the linear electrode member 84 from a DC bias power source E3 through a protective resistor R2. It is preferable from a view point of toner adhering prevention that a DC voltage having the same polarity as that of the toner is impressed upon the linear electrode member 84.

When the DC voltage which is impressed upon the sleeve is equal to the DC voltage which is impressed upon the linear electrode member 84, the DC bias voltage power source E1 can be used for both the above-described purpose as shown in FIG. 1(*c*), so that the apparatus is simplified.

In this example, when the above-described bias voltage is impressed, the first oscillation electric field is generated between the linear electrode member 84 which is integrally provided with the plate-shaped member 83, and the developing sleeve 81 in addition to the oscillation electric field, (which is called the second oscillation electric field), formed between the photoreceptor belt 1 and the developing sleeve 81.

In the above-described color image forming apparatus, a negatively charged OPC photoreceptor is used as the photoreceptor of the photoreceptor belt 1 and reversal development is carried out. When the photoreceptor is charged, for example by –800 V, the bias voltage of –500 V is impressed upon the linear electrode member 84, and the bias voltage of –700 V+an AC component is impressed upon the developing sleeve 81. In the AC component, the frequency is 100 Hz through 20 Khz, preferably being 1 through 10 KHz, and the peak to peak voltage ($V_{P_P}$) is 200 V through 2,000 V.

Because the linear electrode member 84 of the control electrode member 80 is provided in such a manner that the distance between the linear electrode member 84 and the developing sleeve 81 is less than that between the linear electrode member 84 and the photoreceptor belt 1, the strength of the first oscillation electric field is greater than that of the second oscillation electric field.

Since toner particles are oscillated perpendicularly to the line of electric force due to the first oscillation electric field, the toner particles are separated and made to fly from the carrier, and a sufficient misty toner cloud can be generated. This toner cloud can fly easily to the latent image on the photoreceptor belt 1 due to the second oscillation electric field, thereby the latent image is uniformly developed.

At this time, since the AC bias voltage is impressed upon only the developing sleeve 81, the phase of the first oscillation electric field is the same as that of the second oscillation electric field, and toner particles smoothly move from the first oscillation electric field to the second oscillation electric field.

The shape of the AC component is not limited to a sine wave, but may be a rectangular wave or a triangular wave. Depending on frequencies, the higher the voltage is, the more easily the magnetic brush of the developer D is oscillated. Accordingly, toner particles can easily be separated and made to fly from carrier particles. However, fogging or dielectric breakdown such as a thunderbolt-like phenomenon easily occurs. Fogging is prevented by a DC component. The dielectric breakdown can be prevented by the following methods: the surface of the developing sleeve 81 is coated with resin or oxide film so that the surface is insulated or partially insulated; insulating carrier particles, which are described later, are used for carrier particles in the developer D, and the like.

In the developing unit of the present invention, the following operations are conducted: as described above, the magnetic brush of the two-component developer is maintained to be non-contact with the photoreceptor belt 1 which is an image carrier; the toner cloud is generated by the first and second oscillation electric fields; the separation and flying property of the toner to the photoreceptor belt 1 is increased; the selective adsorptivity of the toner to the electrostatic latent image is increased, and adherence of the carrier particle to the photoreceptor belt 1 is prevented; and accordingly, fine particles can be used for toner particles and carrier particles, so that a higher quality image can be developed. For the above-described operations, it is preferable to use developer D composed of the following carrier and toner particles.

Generally, when the average particle size of the magnetic carrier particles is relatively large, the following problems occur: since the bristle of the magnetic brush formed on the developing sleeve 81 becomes rough, nonuniformity easily occurs in the toner image, even when the electrostatic latent image is developed while the electric field is being oscillated; and in this case, since the toner density in the bristle is decreased, the desired high density development can not be carried out. In order to solve this problem, it is preferable to make the average particle size of the magnetic carrier particle relatively small. From the results of the experiments, the following was found: when the weight average particle size is smaller than 50 μm, the above-described problems do not occur. However, the particle size of the magnetic carrier is too small, the carrier and toner particles easily adhere to the surface of the photoreceptor belt 1, or easily scatter. Although these phenomena depend on the strength of the magnetic field acting on the carrier, and also on the strength of magnetization of the carrier, generally, the above-described tendencies begin to appear when the weight average particle size of the magnetic carrier is smaller than 15 μm, and the tendencies frequently appear when the weight average particle size is smaller than 5 μm. Accordingly, in these developing units, it is preferable that the weight average particle size of the magnetic carrier in the developer D is not more than 50 μm, and particularly is not more than 30 μm and not less than 5 μm. When the magnet carrier paticles are spherical, the stirring property of the toner and carrier particles and conveyance property of the developer D are increased, and further, the charge control property of the toner is increased. Accordingly, it is preferable because cohesion between toner particles, and cohesion of the toner particle and the carrier particle can hardly occur.

The above-described magnetic carrier is obtained from the following particles when the particle size is selected by a conventionally known average particle size selection means: spherical particles of ferromagnetic material or paramagnetic material including conventionally used metals such as iron, chrome, nickel, cobalt, etc., or their compounds or alloys, for example, such as triiron tetroxide, γ-ferric oxide, chromium dioxide, manganese oxide, ferrite, mangane-copper alloy; the particles in which the surface of the above-described magnetic particles is spherically coated with resin such as styrene resin, vinyl resin, ethyl resin, denatured rosin resin, acrylic resin, polyamide resin, epoxy resin, polyester resin, silicone resin, etc., or their copolymer resin, or fatty acid wax made of palmitic acid, stearic acid, etc.; or spherical particles made of resin including dispersed magnetic fine powders or spherical particles made of fatty acid wax.

When spherical carrier particles coated with resin or the like as described above are used, the following effects can be obtained in addition to the above-described effects: the developer D layer formed on the developer conveyance carrier becomes uniform; and a high bias voltage can be impressed upon the developer conveyance carrier. That is, when the carrier particles are spherical carrier particles coated with resin or the like, the following effect can be obtained: (1) although generally, the carrier particles are easily magnetized and adsorbed in the major axis direction, the orientation is lost when the particles are spherical. Accordingly, the developer layer can be formed uniformly, and an area in which electrical resistance is partially low and unevenness in the layer thickness can not be generated. (2) As the resistance of the carrier particle is increased, the edge portion which is seen in a conventional carrier particle is lost, and the electric field is not concentrated on the edge portion. As a result, even when a high bias voltage is impressed upon the developer conveyance carrier, the surface of the photoreceptor belt 1 is not discharged and the electrostatic latent image is not disturbed, or breakdown of the bias voltage is not caused. When the high bias voltage can be impressed upon the developer conveyance carrier, the above-described effects can be sufficiently exhibited in the development under the oscillation electric field. When the carrier particles are made spherical, by which the above-described effects are exhibited, the previously described waxes are used. Considering the durability of the carrier, it is preferable that the above-described spherical magnetic particles are coated with resin. It is further preferable that the spherical carrier particles are formed of the magnetic particle having the insulation property in which resistivity of the carrier particle is larger than $10^8$ Ωcm, especially $10^{13}$ Ωcm. This resistivity is obtained as follows: particles are introduced into a container having a cross section of 0.50 $cm^2$ and tamped; a weight of 1 $Kg/cm^2$ is applied on the tamped particles; and a current value is read out when a voltage, which generates an electric field of 1000 V/cm, is impressed between the weight material and a base surface electrode. In cases where this resistivity is low, electric charges are injected into carrier particles when the bias voltage is impressed upon the developer conveyance body; the carrier particle easily adheres to the surface of the photoreceptor belt 1; or breakdown of the bias voltage occurs easily.

Considering the above-described effects as a whole, satisfactory conditions are as follows: the spherical magnet carrier particles are made in such a manner that a ratio of the major axis to the minor axis is, at least, not larger than 3; there are no protrusions such as needle-shaped portions or edge portions; and the resistivity is not less than $10^8$ Ωcm, and preferably not less than $10^{13}$ Ωcm. These magnetic carrier particles are made by the following methods: the resistance of the spherical magnetic particles is increased by formation of an oxide film; in the fine magnetic particle dispersion system carrier, the fine magnetic particles, which are as fine as possible, are used, and after dispersion resin particles have been formed, the particles are made spherial; or the dispersion resin particle is obtained by a spray-dry method.

Next, toner particles will be described below. Generally, when the average particle size of the toner particle is small, qualitatively the charging amount is decreased, being proportional to the second power of the particle size. The adherence force such as Van der Waals forces becomes relatively large; the toner particles are easily scattered; and fogging occurs easily. On the other hand, the toner particle is hardly separated from the carrier particles of the magnetic brush. In a conventional magnetic brush developing method, the above-described problems are prominent when the average particle size is not more than 10 μm. When development, using the magnet brush, is carried out under the double oscillation electric fields in the developing unit of the present invention, the above-described problems can be solved. That is, the toner particles adhered to the bristle of the magnetic brush are intensely oscillated by the first oscillation electric field, easily separated from the bristle, and form the toner cloud. This cloud is conveyed to the nearest developing area A by the inertial force due to the rotation of the sleeve, the centrifugal force due to the oscillation electrical field, and the like. The toner particles are accurately adsorbed onto the electrostatic latent image under the second oscillation electric field. At this time, since the linear electrode member 84 is provided on only the downstream side of the closest contact point 81*b* of the plate-like member 83 and developing sleeve 81, a cloud is not generated in any portion except in the developing area. Further, the toner particles, having a low charging amount, are not moved to the image portion or non-image portion, and the toner does not slide on the photoreceptor belt 1. Accordingly, the toner particles are not adhered onto the photoreceptor belt 1 by triboelectricity, and toner particles having the particle size of about 1 μm can also be used. When the oscillation electric field weakens the combination of the toner particles with the carrier particles, the adherence of the carrier particles accompanied with the toner particles onto the photoreceptor belt 1 is decreased. Further, when the bristle of the magnet brush is maintained in such a manner that it is not in contact with the surface of the photoreceptor belt 1, and the toner particles having a charging amount greater than that of the carrier particles are selectively moved to the electrostatic latent image under the oscillation electric field as described above, then the adherence of the carrier particles onto the photoreceptor belt 1 is greatly decreased.

When the average particle size of the toner is large, as described above, the granular appearance of the image is conspicuous. Generally, in development which has resolving power for resolving fine lines which are arranged in about 10 lines/mm, toner particles having an average particle size of about 20 μm are not a problem. However, when fine particle toner having an average particle size of less than 10 μm is used, the resolving power is greatly increased, and clear high quality images, in which images of variable density are accurately reproduced, can be obtained. From the reasons described above, the following are desirable conditions: the average particle size of toner is not greater than 20 μm, and preferably, not greater than 10 μm. Further, since the toner particle follows the electric field, the absolute value of the charging amount of the toner particle is not less than 1 μC/g through 3 μC/g (preferably 3 μC/g through 100 μC/g). Particularly, when the particle size is small, a largeer charge amount is necessary.

The above-described toner can be obtained by methods of pulverizing granulation, suspension polymerization, emulsion polymerization, etc., in the same manner as conventional toners. That is, toner obtained by selecting spherical or amorphous, magnetic or non-magnetic toner particles in a conventional toner by an average particle size selecting means, can be used. Further, the toner particles may also be magnetic particles including fine magnetic particles. In this case, the amount of fine magnetic particles is preferably not more than 60 wt %, and more preferably not more than 30 wt %. When the toner particles include fine magnetic particles, the toner particles are influenced by the magnetic power of the developer conveyance carrier, so that the uniform-formation property is further increased, fogging is prevented, and further, the toner particles hardly scatter. However, when the amount of the magnetic material included in the toner particles is too large, the magnetic force between the toner particles and the carrier particles is too large, so that sufficient development density can not be obtained. Further, the fine magnetic particles emerge on the surface of the toner particles, triboelectricity control becomes difficult, and the toner particles are easily damaged.

Summing up the foregoing, in the developing unit of the present invention, the toner particles are preferably made of the following particles: the particles having an average particle size of not more than 20 μm, particularly not more than 10 μm, which can be made by the same methods as conventionally known toner particles when resin as described in regard to the carrier particles, and the fine magnetic particles are used, and are then added with coloring components such as carbon, etc., and charging control agents, etc. as necessary.

In the developing unit of the present invention, the developer in which the above-described spherical carrier particles and toner particles are mixed at the same ratio as that in a conventional two-component developer, is preferably used. Further, when necessary, fluidity agents for improving the fluidity of particles or cleaning agents for cleaning the surface of the image carrier are mixed into this developer. Colloidal silica, silicone varnish, metallic soap, or nonionic surface active agents may be used as the fluidity agents. Fatty acid metallic salt, organic group substitution silicone or fluorine surface active agents may be used as cleaning agents.

(EXAMPLE 1)

In the above-described developing unit, the following carrier particles are used: the spherical magnetic carrier particles having a weight average particle size of 30 μm and resistivity of more than $10^{14}$ Ωcm, which is obtained when methyl methacrylate/styrene copolymer resin is coated on the surface of the spherical ferrite particles with a magnetization strength of 50 emu/g. The following toner is also used in the developing unit: toner composed of nonmagnetic particles which are obtained by a pulverizing granulation method and made of particles having a weight average particle size of 8 μm made of: styrene acrylate resin (Hymer u p 110 made by K. K. Sanyo Kasei) of 100 weight parts, carbon black (MA-100 made by K. K. Mitsubishi Kasei) of 10 weight parts, and nigrosine of 5 weight parts. Development was carried out by the apparatus shown in FIGS. 1 and 2 under the conditions that the ratio (wt %) of the toner particles to the carrier particles in each developer D in the developer reservoir 88 was 10 wt %. The average charging amount of each toner was −18 μC/g.

In this case, the following conditions were set: the OPC photoreceptor is used as the photoreceptor belt 1, with a peripheral speed of 180 mm/sec; the maximum potential voltage of the electrostatic latent image formed on the photoreceptor belt 1 is −800 V; the outer diameter of the developing sleeve is 30 mm; and the number of rotations of the developing sleeve is 150 rpm; the magnetic flux density of the main magnetic pole 82*a* which is opposite to the developing area A of the magnetic body 82 is 1200 gauss; the thickness of developer D layer is 0.4 mm; the gap between the developing sleeve 81 and photoreceptor belt 1 is 0.7 mm; $\theta_1$=2°, $\theta_2$=4°, $\theta_3$=30°, $\theta_4$=−30°; the bias voltage impressed upon the developing sleeve 81 is a DC component of −700 V; the frequency of an AC component is 8 KHz; and the peak to peak voltage is 1000 V.

Figure 8:
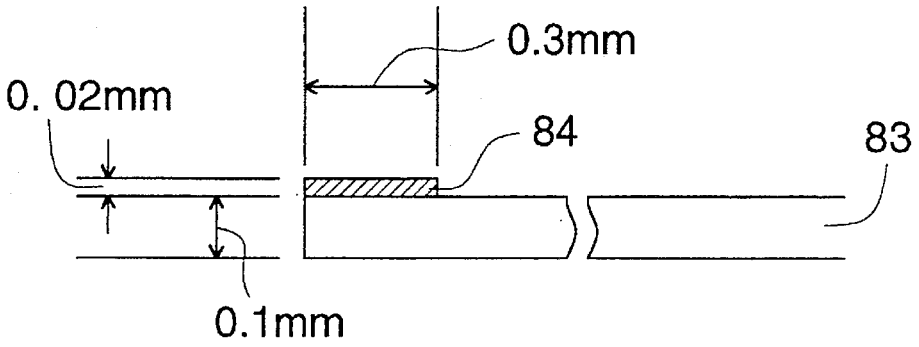
FIGS. 8(*a*) and 8(*b*) are views showing the configuration of the plate-shaped member 83 and the line-shaped electrode 84 of examples 1 through 4.
Figure 8:
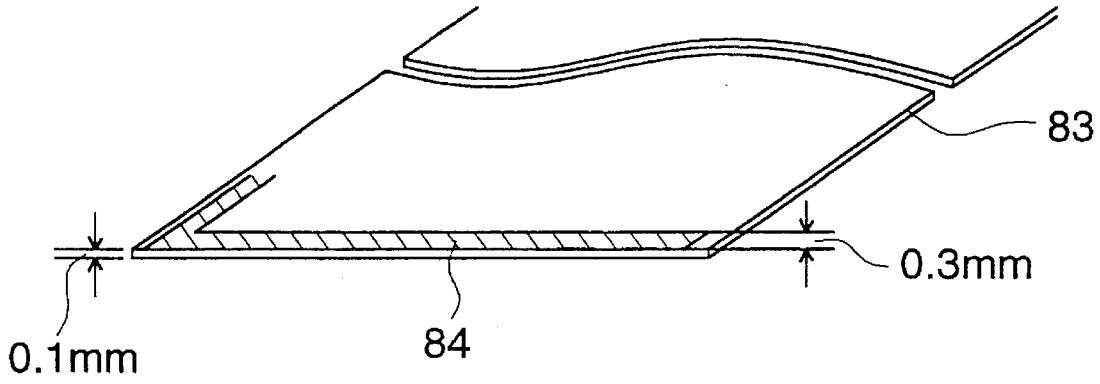

Glass epoxy having a thickness of 0.1 mm is used as the plate-shaped member 83 of the control electrode member 80, and as shown in FIG. 8, the linear electrode member 84 having a length of 0.3 mm in the direction of periphery is formed on the end of the surface of the image forming body side of the plate-shaped member 83 by a laminate-etching method using a copper foil having a thickness of 0.02 mm. A DC voltage of −700 V is impressed upon the linear electrode member 84.

In this example, developer D on the developing sleeve 81 is not in contact with the surface of the photoreceptor belt 1.

Development was carried out under the conditions described above. The superimposed color toner image was formed on the photoreceptor, and transferred onto a transfer sheet of regular paper by corona discharging. After the transfer sheet was passed through a heat roller fixing unit having a surface temperature of 140° C., the image was fixed. As a result, the recorded image on the transfer sheet was free from edge effects or fogging, the density of the image was high, and the image was clear. In succession to the above experiment, recording of 50000 sheets was carried out. Stable recorded images, which did not variy during the test, were obtained.

Figure 7:
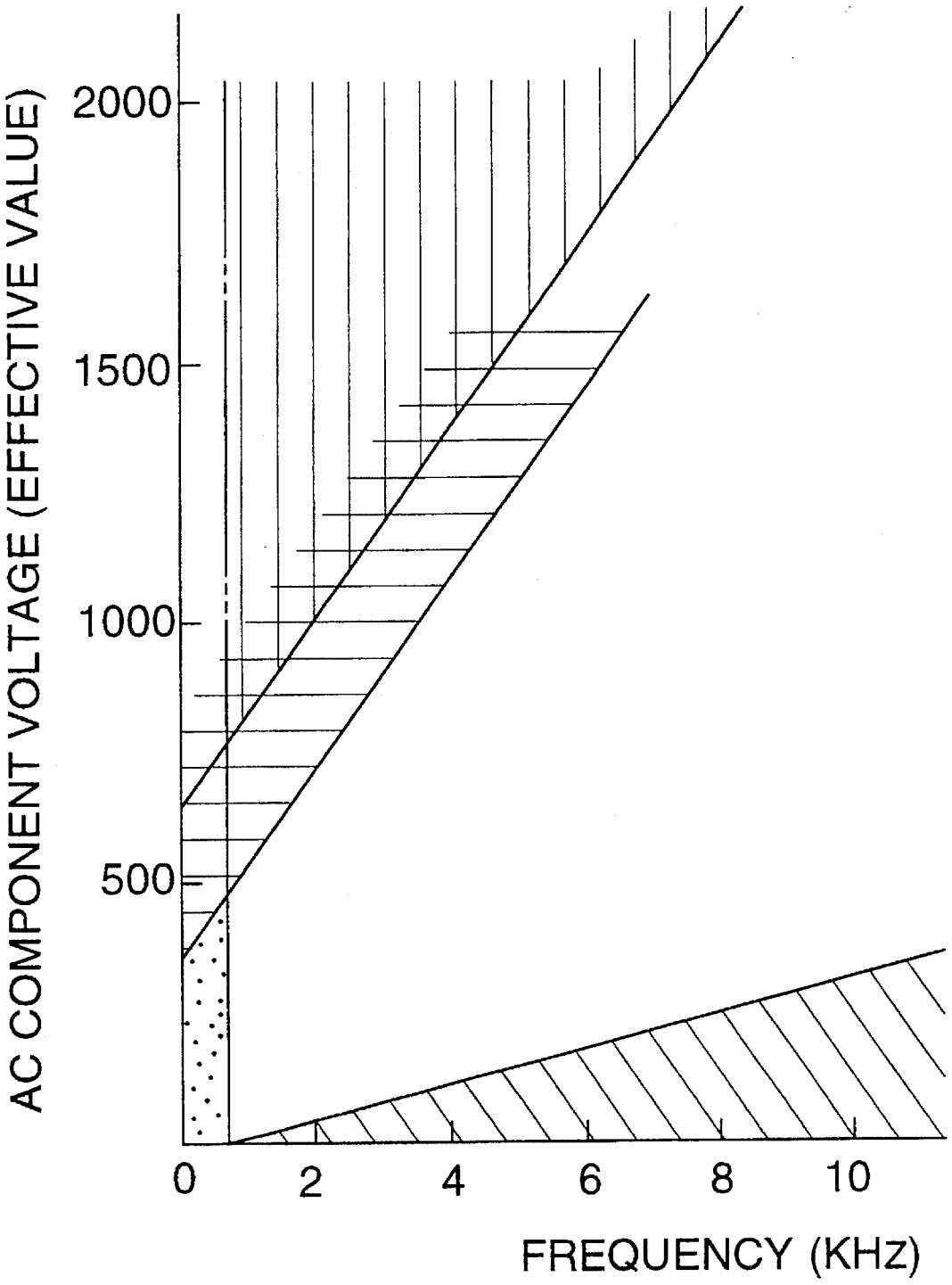
FIG. 7 is a graph showing a preferable range of an AC component of a bias voltage.

In the above example, the result, in which the frequency of the AC component voltage impressed upon the developing sleeve 81 and the effective value voltage were varied, is shown in FIG. 7. In FIG. 7, a range, shown by hatched horizontal lines, is the range in which fogging easily occurs; a range hatched by vertical lines is the range in which insulation breakdown easily occurs; a range hatched by inclined lines is the range in which the image quality is easily lowered; and the range having no hatched line is the preferable range in which stable and clear images can be obtained. As can clearly be seen from the drawing, the range, in which fogging easily occurs, varies due to change of the AC component. In this connection, the wave shape of the AC component is not limited to a sine wave, but may be also a rectangular or a triangular wave. A low frequency region shown by dots in the drawing is the range in which uneven development occurs because the frequency is low.

In the above example, when the toner in the two-component developer is magnetic, it is needless to say that a magnetic latent image can also be visualized under the same conditions as those described above.

By the structure described above, in the developing unit of the present invention, the following effects can be obtained:

(a) Since the main magnet pole is positioned near the developing area, and a control electrode having the linear electrode, upon which bias voltage can be impressed, is located on the main magnet pole or at the upstream side of the main magnet pole, bristling of the magnetic brush is good, and even when carrier particles having an average particle size of not more than 30 μm or toner particles having an average particle size of not more than 10 μm is used in the developing unit of the present invention, no problems occur. Accordingly, this developing unit can be used in an image forming apparatus in which a multi-color image, formed by superimposing the toner image on the image forming body, is collectively transferred onto the transfer sheet so that a color image is obtained, and highly stable developability can be obtained.

(b) Since the whole linear electrode in the control electrode is positioned on the downstream portion of the closest position between the control electrode and the developer conveyance body, undesirable clouding does not occur on the developer conveyance path, so that stable conveyance amounts of the developer can be obtained.

(c) A DC bias voltage having the same polarity as that of the toner charging voltage can be impressed upon the linear electrode portion, the toner is not piled up and the image is not stained.

(d) Since a bias voltage, in which an AC voltage is superimposed on a DC voltage, is impressed upon the developing sleeve, and only the DC voltage is impressed upon the linear electrode, the phase of the AC bias voltage is not disturbed in the developing area, and development can be carried out smoothly and superbly.

The present invention can provide a superior developing unit having the foregoing effects.

Next, a developer smoothing member, which can also be used for the plate-shaped member 83 to attain the first object of the present invention, and can attain the second object of the present invention, will be described below.

The developer smoothing member according to the present invention is formed of resin which is reinforced with inorganic fibre or organic fibre (fiber).

An insulation member for composing a control electrode member according to the present invention is also formed of resin which is reinforced with inorganic fibre or organic fibre.

The following inorganic fibre can be used in the present invention: whisker (needle crystal), polycrystal or amorphous short fibre, or continuous fibre; or fibre formed when they are variously processed.

Very few transitions occur in the whisker and its strength is close to the ideal value of inorganic crystals. The resin reinforced with the whisker can be molded by general molding methods such as injection molding, which is advantageous. For such the whisker, the following can be used: for example, hexagonal system α-SiC whisker, cubic system β-SiC whisker, $\alpha$-$Si_3N_4$ whisker, $K_2O$ $6TiO_2$(6 potassium titanate) whisker, graphite whisker, $\beta$-$Si_6$-zAlzOz$N_8$-z (sialon) whisker, $ZrO_2$ whisker, etc.

Inorganic short fibres are not monocrystal fibres and are fibres having a definite length which is normally more than 1 mm, and less than 10 cm. As such inorganic short fibres, for example, the following fibres can be used: glass fibres, carbon fibres, alumina short fibres, alumina silica short fibres, $ZrO_2$ short fibre, boron nitride short fibres, etc.

Inorganic continuous fibres have a length not less than that of the member and are largely classified into two groups depending on the diameter. The first are fibres having a diameter of 100 through 200 μm, and are used as a monofilament. Boron or SiC is caused to grow on the surface of the filament by CVD. The second are fibres which have diameters of smaller than 20 μm, and the fibres are bundled and are used as a multi-filamemt. When the fiber is woven or a member having a complex shape is formed, the latter is better. When a continuous fibre is used, generally, a member, in which fibre arrangement is controlled and which has a high composition fibre content ratio, can be molded, and the strength and rigidity of the member can be greatly increased. However, it is necessary to use a special molding means, and further, secondary plastic working can not be carried out. As such inorganic continuous fibres, the following can be used: various glass fibres, fused silica, tungsten core wire boron continuous fibres (monofilament), tungsten core wire B4C continuous fibers (monofilament), tungsten core wire silicon carbide-boron continuous fibres (monofilament), carbon fibre core wire SiC continuous fibres (monofilament), fused quartz core wire boron continuous fibres (monofilament), BN continuous fibres, SiC continuous fibres, Si—Ti—C—O (B) continuous fibres (tyrano fibre), alumina continuous fibres containing properly $SiO_2$, $B_2O_3$, PAN carbon continuous fibres, pitch carbon continuous fibres, $ZrO_2$ long fibres; and various type metallic continuous fibres, for example, tungsten continuous fibres, molybdenum continuous fibres, steel continuous fibres, beryllium continuous fibres, super heat-resistant nickel alloy (Renel 41) continuous fibres, stainless steel continuous fibres, etc.

In inorganic fibres, the following glass fibres can be used at particularlly low cost: E-glass fibres, C-glass fibres, A-glass fibres, S-glass fibres, M-glass fibres, fused quartz, etc.

In many cases, glass fibres are surface-processed according to common methods using organic chrome complex compound, organic silane compound, or the like.

Fibres composed of organic high polymer materials of a wide range can be used as organic fibres used in the present invention. Normally, organic fibres which are heat stretched so that the number of high polymeric chains, which are stretched to their full length, are increased in a unit sectional area, or polymers having rigid high polymer chain are used in many cases. Aramide fibres are advantageously used for improving the modulus of elasticity of the reinforced member. Further, alamide pulp which is processed into fine fibres can be used in the same manner. Liquid crystal polymer fibres are high in buffering property, and is advantageously used for improving shock resistance, durability, and anticorrosion properties. Specifically, when liquid crystal fibres having a modulus of high elasticity, which can be obtained recently, are used, they can be effective for improving the modulus of elasticity. Super high molecular weight polyethylene fibres are not heat resistant, and accordingly, it is necessary to pay attention to molding temperature. However, it can be advantageously used for improving the modulus of elasticity and shock resistance. A hybrid woven fabric of super high molecular weight polyethylene and carbon fibre effectively makes up for the adhesive property of polyethylene fibres and the shock resistance of carbon fibres. The following fibres can also be used: polyvinyl alcohol fibres, specifically, polyvinyl alcohol fibres of high performance grade (vinylon fibres); hetero ring aromatic polymer fibres such as polyparaphenylene benzo bisthiazole; acrylic fibres; or polyester fibres.

The above-described inorganic fibres and organic fibres are used in various forms. For example, glass fibres are used in the following forms: strand; roving; yarn; continuous strand mat; scrim cloth; chopped strand mat; surface mat; robing cloth; glass cloth (into which yarn is woven); chopped strand; chipped strand; glass powder; milled fibre, etc.

Carbon fibre is also used in the same forms as glass fibre, as follows: strand; tow (which corresponds to robing in glass fibre); yarn; cloth (woven with tow or yarn); chopped strand; one-way materials. Other fibres are also used in similar forms.

Fibres for reinforcement used in the developing unit of the present invention should be used at a ratio at which the tensile strength and modulus of elasticity for bending of moldings become the highest. Further, since the member of the present invention requires a flat surface, the fibres should be used within the limit in which these fibres are not exposed on the surface and a smooth molding surface can be obtained. This most appropriate ratio for use is increased when generally, fibre for reinforcement is woven into the member. Further, the higher the affinity between resin matrix and fibre is, the higher the ratio becomes. For the reasons described above, the fibres used in the present invention are contained in the molding at the ratio of 2 through 80 weight %, and preferably 5 through 60 weight %.

Resins used in the present invention can be either thermoplastic resins or thermosetting resins.

When thermoplastic resin is used, it can be manufactured by the production method of injection molding or extrusion molding, as described later, which is good for mass-production and is low in production cost. The mass-productivity is also enhanced by the reason in which the preservation stability of raw materials is good. Further, toughness of the member obtained from thermoplastic resin is superior compared to thermosetting resin. Further, since there are many kinds of thermoplastic resins, the degree of freedom of material design is high. Still further, these resins can be melted and formed repeatedly, so that these resins can be recycled, which is one of the features.

As thermoplastic resins used in the present invention, so-called general purpose resins, and various crystalline or non-crystalline high polymer materials belonging to a category called engineering plastic or super engineering plastic can be used.

As thermoplastic resins which are classified into general purpose plastics, homopolymer or copolymer such as polyethylene, polypropylene (they are crystalline), polyvinyl chloride, polystyrene, ABS resin, AS resin, methacrylic resin (they are non-crystalline), can be used.

Of course, thermoplastic resins which are classified into general purpose plastic can also be applied to the present invention. However, thermoplastic resins which are classified into engineering plastic or super engineering plastic can be more advantageously used in the present invention. As thermoplastic resins which is classified into so-called engineering plastic or super engineering plastic, the following can be used: super high polymer molecular weight polyethylene, poly-4-methyl penten-1, nylon (nylon-6, nylon-66, nylon-11, nylon-12, etc.), polyacetal, polybuthylene terephthatate, polyethylene terephthalate, the entire aromatic polyestercontaining paraoxybenzoyl group, polyphenylene sulfide, polyetherether ketone, polyamideimide (which are crystalline), polyphenylene ether, polycarbonate, polyallylate (polyester of dihydric phenol and aromatic dicarboxylic acid), polysulfone, polyether sulfone, polyether imide (which are non-crystalline), etc.

There are thermoplastic resins which display the same physical characteristics as those of engineering plastic although they have the chemical structure to be classified into general purpose plastics. For example, they are as follows: syndiotactic polystyrene, metallocene polymerization polyethylene, isotactic polypropylene, and syndiotactic polypropylene, which are called metallocene polymerization polymer. They have superior mechanical characteristics (rigidity, shock resistance), heat resistaance property, etc., compared with regular resins having the same chemical structure, so that they are advantageously used in the present invention.

As resins which are classified into thermoplastic resins and can be advantageously used in the present invention, there are fluorine contained resins in addition to the above-described resins. As fluorine contained resins, the following resins are shown: polytetrafluoroethylene, tetrafluoroethylene-perfluoroalkyl vinylether copolymer, tetrafluoroethylene-hexafluoropropylene copolymer, polychloro trifluoroethylene, tetrafluoroethylene-ethylene copolymer, chlorotrifluoro ethylene-ethylene copolymer, polyvinylidene fluoride, polyvinyl fluoride, etc.

When thermosetting resins are applied to the present invention, generally, it is necessary to pay attention to that member manufacturing means are used which are different from those in the case where thermoplastic resins are applied. However, in these special manufacturing means which are different from injection molding or extrusion molding, relatively long inorganic fibres or organic fibres, or products made of these fibres can be used, and a smoothing member and control electrode member which have superior tensile strength and modulus of elasticity for bending, can be advantageously realized.

As thermosetting resins, the following resins can be used: unsaturated polyester resin, epoxy resin, vinylester resin, phenol resin, thermosetting poliimide resin, thermosetting polyamideimide, and the like.

As unsaturated polyester resins, the following resins are listed: orthophthalicacid resin; isophthalic acid resin, terephthalic acid resin; bisphenol resin; propylene glycolmaleic acid resin; low styrene volatile resin, in which dicyclopentadiene or its derivatives are introduced into unsaturated polyester composition so that the molecular weight of the low styrene volatile resin is low, or to which a wax compound suitable for forming a coating is added; low contractive resin to which thermoplastic resins (polyvinyl acetate resin, styrene butadiene copolymer, polystyrene, saturated polyester, etc.) are added; reaction type resin in which unsaturated polyester is bromized directly by $Br_2$, or het acid and dibrom neopentylglycol are copolimerized; a combination of halogenide such as chlorinated paraffin or tetrabrombisphenol, with antimony trioxide or phosphorus compounds; nonflammable resin of addition type in which aluminum hydroxide or the like is used as additives; or highly rigid resin (high mechanical strength, high modulus of elasticity, high elongation ratio) which is hybridized or IPN processed with polyurethane or silicone.

As epoxy resins, the following resins are shown: glycidyl ether epoxy resin containing bisphenol A type, novolak phenol type, bisphenol F type, or bromine bisphenol A type resin; or special epoxy resin containing glycidyl amine, glycidyl ester, cyclic fat, or heterocyclic ring type epoxy resin.

Vinyl ester resin is a resin in which oligomer obtained by ring-opening addition reaction of regular epoxy resin and unsaturated monobasic acid of methacrylic acid, is dissolved in a monomer of styrene or the like. Further, different from the above-described resins, there are special type resins which have a vinyl group at the ends of molecular or side chains and contain vinyl monomers. As vinylester resins of glycfidyl ether epoxy resin, the following resins are listed: bisphenol, novolak, bromine, and bisphenol resins. As special vinyl ester resins, the following resins are listed: vinyl ester urethane, isocyanuric acid vinyl, and side chain vinyl ester resins.

Phenol resin is obtained when phenol classes and formaldehyde classes are used as raw materials and are polymerized. As phenol resins, the following resins are listed: resol type and novolak type resins.

As thermosetting polyimide resins, the following resins are listed: maleic acid polyimide, for example, polymaleimide amine, polyamino bismaleimide, bismaleimide o, o'-diaryl bisphenol-A resin, bismaleimide triazine resin; nadic acid denatured polyimide; and acetylene end polyimide, etc.

Manufacuring methods for the member used for the developer smoothing member of the present invention and an insulation member of which the control electrode member is composed, differ depending on types, configuration, or kinds of resins of reinforcement fibres for composing the members, specifically, depending on whether the resin to be used is thermoplastic or thermosetting.

When thermoplastic resin is reinforced with inorganic fibres or organic fibres which are short and not provided with a secondary configuration by weaving or the like, then generally used molding methods are applied to thermoplastic resin molding. In this case, resins in the configuration called FRTP pellets can be used as raw materials. That is, unfused or fused thermoplastic resins and additive materials such as short fibre reinforcement materials, and filler when necessary, are thermally kneaded and extruded into strand-shape by a kneading-extruder. The obtained material is then processed as follows: the material is cut after cooling, or in the molten state; or while a bundle of roving-like long fibers are passed through a die, the material is adhered and impregnated with molten resins and other resins, and then cut in predetermined lengths. After the above-described processing, pellet-shaped materials can be obtained and can be used as raw materials. The reinforcement material is used in the ratio of 2 through 80 weight %, preferably 5 through 60 weight %, and the range of the ratio can be broadened in FRTP which is produced using a bundle of long fibres. When FRTP is molded into the insulation member of the present invention by an injection molding machine, the reinforced fibres are shortened by cutting. In the case of glass fibres, generally, the cut length is 0.2 through 0.8 mm in the weight average unit. For molding in the case of the above-described thermoplastic resin, the following processing can be used in addition to injection molding: extrusion processing; blow molding; injection blow molding; compression molding;

rotational molding; casting; transfer molding; or powder processing; solvent coating; machining, etc. For the easiest molding, the following can be used: injection molding; extrusion molding; cast molding; and compression molding. Further, a special molding method, which is called RIM, can also be used. For example, in the case of nylon, lactam to which reinforcement fibres, catalyst and active agents are added, is injected into a metallic mold, and then the product can be obtained by anionic polymerization.

Polytetrafluoroethylene has a high melt viscosity, so that a general melt processing method can not apply to it. Accordingly, it is molded by any of the following methods: compression molding, ram extrusion molding, paste extrusion molding, a dispersion method, etc.

The member used for the smoothing member which is made of thermosetting resin reinforced with inorganic fibre or organic fibre, and the insulation member for composing the control electrode member, are sometimes manufactured by injection molding or transfer molding in the same way as those for thermoplastic resins.

As the simplest manufacturing method for the smoothing member which is made of thermosetting resin reinforced with inorganic fibre or organic fibre, and the insulation member, of which the control electrode member is composed, there is a method in which intermediate products, which are respectively called SMC, BMC, and prepreg, are used.

SMC (sheet molding compound) is a sheet-like molding material, and is made by the following process: a resin compound in which thermosetting resin and, when necessary, thickner, filler, mold releasing agent are mixed, is impregnated into the material having the configuration corresponding to roving or a chopped strand mat which is formed of glass fibres made of organic or inorganic fibres; both surfaces of this material are coated with non-adhesive sheets made of polyethylene, etc.; the viscosity of the resin compound is increased by thickner; and the material is processed so that it does not adhere easily. At the time of molding, the required amount of the material is cut; the sheet made of polyethylene, etc., is peeled; the material is loaded into the metallic mold; and the material is then heated and pressurized for hardening. This material is solid, easily handled, and advantageous for automation while the resin used for pre-form molding or other molding processes is liquid. In the metallic mold, reinforcement fibres flow together with the resin compound, which is a feature of this processing, and a better molding surface can be obtained compared with pre-form molding procedures. Further, as compared with BMC injection molding or other molding methods, the reinforcement fibres are not destroyed until the last molded product, so that molded products having superior strength can be obtained.

In contrast to this, BMC is a material processed as follows: thermosetting resin, short reinforcement fibres, and when necessary, fillers, pigments, hardening agents are kneaded, and premix, which is a putty-like molding member, is produced; in this premix, a solidified or pre-molded material having superior physical properties in which specifically the material has no surface ripples, no shrinkage, its surface is flat, and camber hardly occurs, is called BMC. Many times, BMC is added with thermoplastic resin and the contraction property of the BMC is decreased. BMC has the following features: materials having complicated shapes can be integrally molded; its molding speed is high; and inserts, attachments, holes, screws, ribs, and bosses can be molded.

The following materials are called prepreg: the material in which longer reinforcement fibres than SMC are arranged; the material in which anisotropy of the fibre orientation is lost by superimposing several layers of the above-described material; the material obtained after thermosetting resins and fillers or pigments, when necessary, have been added to cloth or the like into which reinforcement fibres have been woven, and the product obtained by this processing has been impregnated with solvents or the like, dryed and half-hardened. Molding prepreg products can be obtained by press molding or the like.

As a general molding method of thermosetting resins which are reinforced with organic or inorganic fibre, the following methods are listed: a hand lay-up method; a spray-up method; a mat or pre-form matched die method; a pre-mix method; a filament winding method; a pressurization pressure reduction rubber bag method; a continuous protrusion method, etc. Since members used for the developer smoothing member, or insulation members, of which a control electrode member of the present invention is composed, have a relatively simple shape, the following methods are especially advantageous: a mat or pre-form matched die method; a premix method; a pressurization pressure reduction bag method; and a continuous protrusion method. In the mat or pre-form matched die method, moldings are obtained by the following method: a material obtained when thermosetting resins (thermoplastic resins may also be used) a binder is impregnated into the reinforcement fibre mat such as a chopped strand mat, or reinforcement fibres such as chopped strands or the like formed in a preliminary process, is pressed and heated in a set of metallic dies. In the pre-mix method, the moldings are obtained by compression molding, transfer molding, or injection molding using the foregoing pre-mix. The pressurization pressure reduction bag method is a method in which a base material of glass fibre of prepreg is put on one of a set of metallic dies, and is covered with a film such as PVA or the like; and for molding, this system is then pressurized from the outside, or the inside of this system is evacuated. The continuous protrusion method is a method in which roving, tow, or the like is arranged, and after it is dipped into resin or a resin mixture, it is molded into moldings having the predetermined sectional shape with dies, and next, the moldings are hardened in a heating furnace.

In this process of molding, sometimes, various additives are used in addition to inorganic fibres, organic fibres, thermoplastic resins, or thermosetting resins. Particularly, when thermosetting resin is used, hardening agents and hardening acceleration agents are used in many cases. Organic paraoxide, azo compound, etc. are used as hardening agents. In some cases, an ultraviolet ray or a sensitizer for visual light hardening is also Used. As acceleration agents, amine, or naphthenic acid metallic salt, etc. are used for hardening at normal temperatures.

When fillers are used, in some cases, there is an effect in which physical properties such as the mechanical strength, thermo-conductivity, abrasion resistance, nonflammability, etc. of moldings are improved due to the shape of particles or surface effects. Calcium carbonate, alumina, talc, diatomaceous earth, clay, kaolin, mica, barium sulfate, gypsum, silica gel (aerosil), or further, glass balloons, shirasu balloon, etc. are used independently or in combination therewith.

When coloring agents are used, generally, paste colors into which pigments are previously kneaded, are used. However, powders such as carbon black, or titanium white, etc. are used in some cases.

As mold release agents, external mold release agents, and/or internal mold release agents are used. Specifically, the following agents are presented: stearic acid, zinc stearate, magnesium stearate, calcium stearate, aluminum distearate, soybean lecitin, various types of waxes, poval, silicone, etc.

Thickeners and thixo supplying agents are also used in addition to the above-described chemical agents.

In order to manufacture the control electrode member using the insulation member molded as described above, the following operations are carried out. When the electrode member is attached to the insulation member, it is most effective that the electrode material made of electrolytic copper foil or other members is molded into layers at the same time when the insulation member is molded, for example, press-molded, using adhesive agents as necessary. However, any of the following methods can also be used: a method in which the electrode member is adhered onto the molded insulation member; or a thermal fusing method. Further, in order to attach the electrode member onto a limited portion of the control electrode member, the electrode can be attached onto this portion. However, the following method is advantageous: the electrode is attached onto a broader portion; after that, unnecessary electrode member portions are removed by a so-called etching method. Further, the following method can be carried out: the electrode member is located on the insulation member by printing with electroconductive inks, printing with electroconductive paints, or coating with electroconductive ink or paints.

Specifically, an embodiment in which the developer smoothing member for the developing unit or the control electrode member for the developing unit, which are manufactured in any of the above-described manner, is assembled into an electrophotographic developing unit, will be described below.

Figure 9:
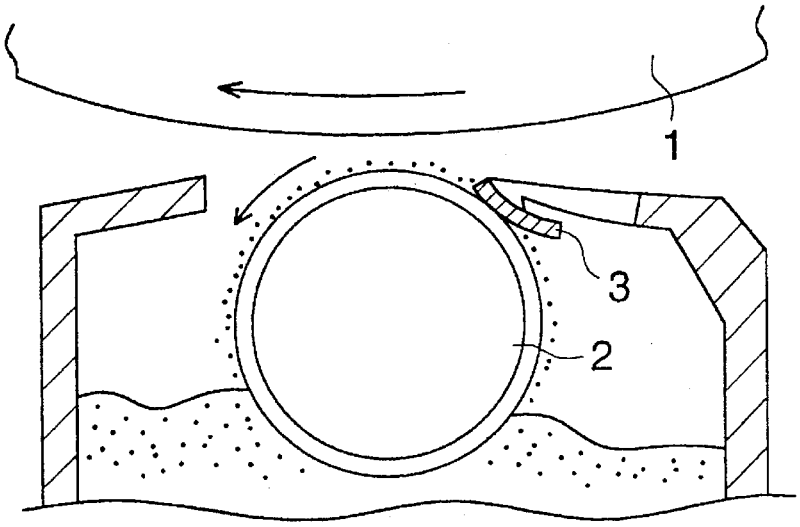
FIG.9 (PRIOR ART)
FIG. 9 is a view showing an outline of an embodiment relating to a technology to attain the second object of the present invention.
Figure 10A:
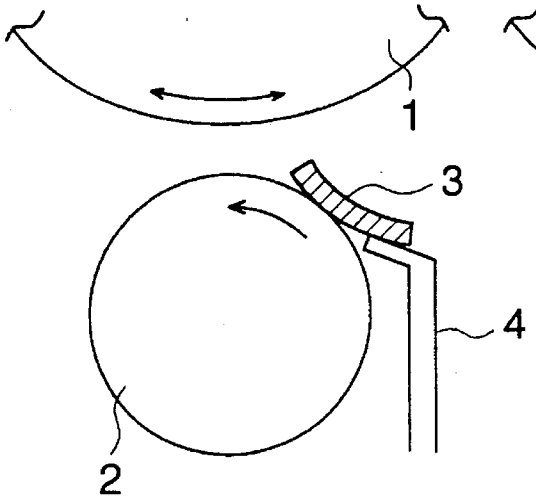
FIG.10(a) (PRIOR ART)
FIGS. 10(*a*) and 10(*b*) are views showing an outline of an embodiment relating to a technology to attain the second object of the present invention.
Figure 10B:
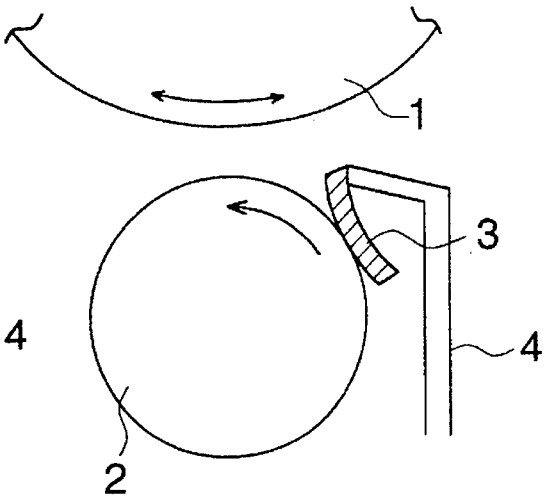
FIG.10(b) (PRIOR ART)

In the case of the developer smoothing member, the following prior technologies have been disclosed: Japanese Patent Publication No. 16736/1988; Japanese Patent Publication Open to Public Inspection No. 36383/1992; and Japanese Patent Publication Open to Public Inspection No. 289522/1993. That is, as disclosed in Japanese Patent Publication No. 16736/1988, the smoothing member is used as follows: in order to regulate the layer thickness of the developer supplied onto a movable developer conveyance body, the smoothing member is used as an elastic regulation plate for pressure-contact in the opposite direction in which the inner surface of the smoothing member is pressure-contacted with the developer conveyance body, and the member has a free end at the upstream side with respect to the movement direction of the developer (FIG. 9). This regulation plate is used as a conductive elastic regulation plate, the inner surface of which is in pressure-contact with the developer conveyance body (FIGS. 10(*a*) and 10(*b*)).

Figure 11:
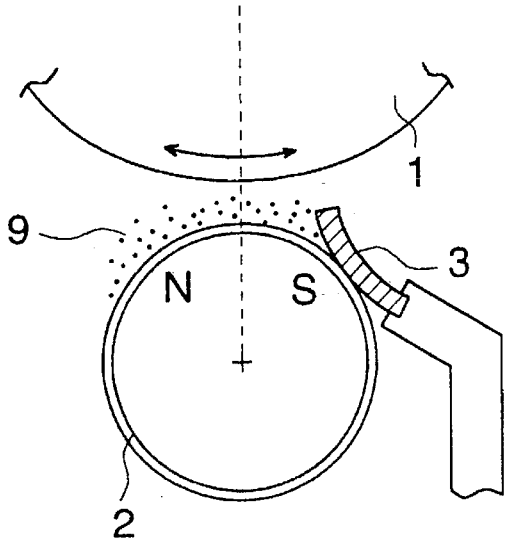
FIG. 11 (PRIOR ART)
FIG. 11 is a view showing an outline of an embodiment relating to a technology to attain the second object of the present invention.
Figure 12:
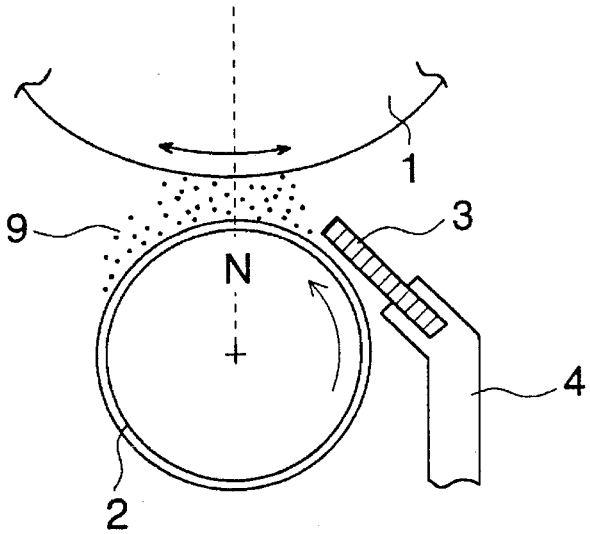
FIG. 12 (PRIOR ART)
FIG. 12 is a view showing an outline of an embodiment relating to a technology to attain the second object of the present invention.

As disclosed in Japanese Patent Publication Open to Public Inspection No. 36383/1992, in a non-contact two-component developing unit for applying an oscillation electric field to a developing area which is sandwiched between two magnetic poles having respectively different polarity which are provided in the developer conveyance body, the smoothing member may be provided as a press member in order to press the two-component developer at the positions of the magnetic poles (FIG. 11). Further, as disclosed in Japanese Patent Publication Open to Public Inspection No. 289522/1993, the smoothing member can be used as a non-magnetic developer smoothing means which is provided so that the smoothing member is in contact with the developer at the upstream side of the magnet poles provided in the developer conveyance body in such a manner that the magnet poles are opposite to the developing area (FIG. 12).

Figure 13:
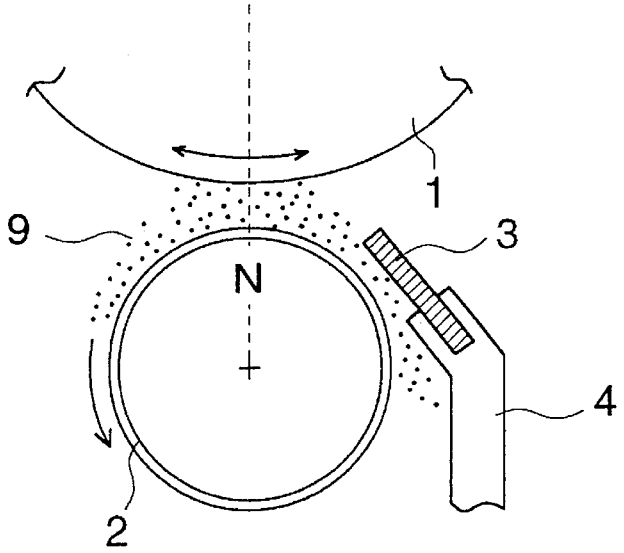
FIG. 13 is a view showing an outline of an embodiment of an smoothing member which is in contact with the developer of the present invention.
Figure 14:
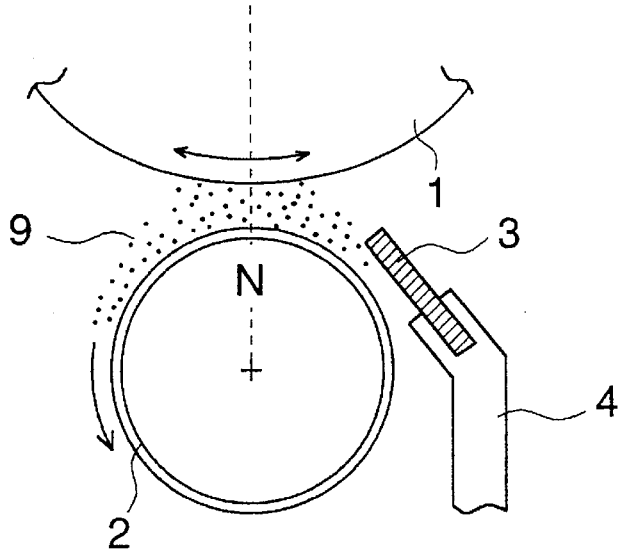
FIG. 14 is a view showing an outline of an embodiment of an smoothing member which is in contact with the developer of the present invention.
Figure 15:
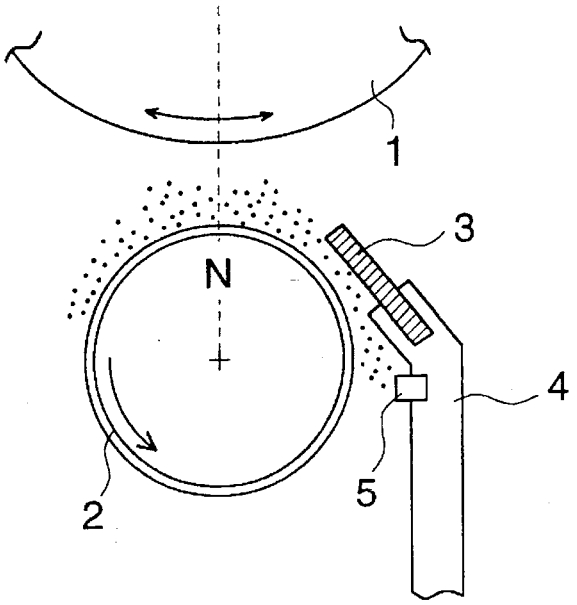
FIG. 15 is a view showing an outline of an embodiment of an smoothing member which is in contact with the developer of the present invention.
Figure 16A:
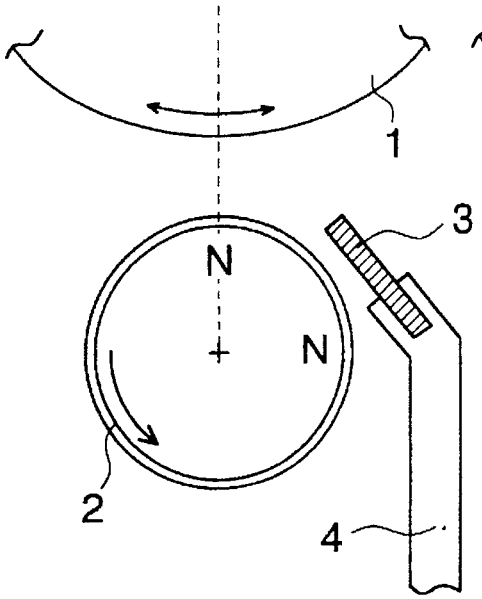
FIGS. 16(*a*) and 16(*b*) are views showing an outline of an embodiment of an smoothing member which is in contact with the developer of the present invention.
Figure 16B:
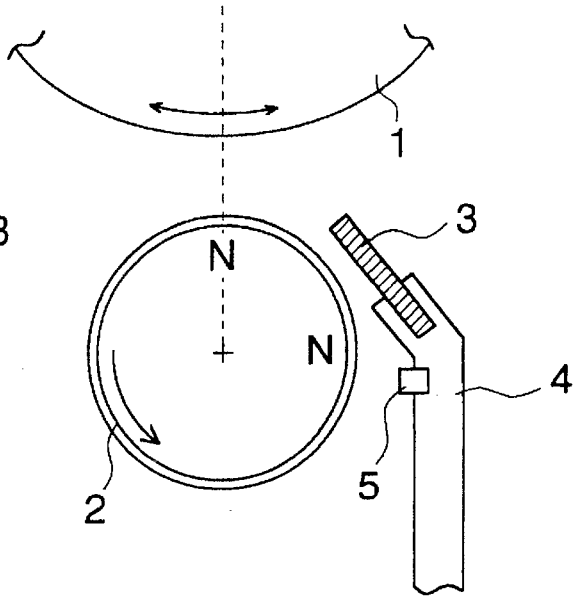

Further, in the developing unit having the developer regulation means which is provided at a predetermined distance from the surface of the developer conveyance body for regulating the thickness of the developer layer on the surface of the developer conveyance body so that the developer can come into contact with the surface of the latent image carrier provided opposite to the developer layer, the smoothing member can be used as the non-magnetic developer smoothing means which is provided for contacting with the developer at the upstream side of the magnet pole provided in the developer conveyance body in such a manner that the magnet pole is opposite to the developing area (FIG. 13). Further, in the developing unit having the developer regulation means which is provided at a predetermined distance from the surface of the developer conveyance body for regulating the thickness of the developer layer on the surface of the developer conveyance body so that the developer can come into contact with the surface of the latent image carrier provided opposite to the developer layer, the smoothing member can be used as a non-magnetic developer smoothing means which is provided for contacting with the developer at the upstream side of the magnet pole provided in the developer conveyance body in such a manner that the magnet pole is opposite to the developing area, other than the above-described developer regulation means (FIG. 14). Further, in the developing unit having the developer regulation means which is provided at a predetermined distance from the surface of the developer conveyance body, the smoothing member can be used as a non-magnetic developer smoothing means which is provided for contacting with the developer at the upstream side of the magnet pole provided in the developer conveyance body in such a manner that the magnet pole is opposite to the developing area, and is provided so that the thickness of the developer layer on the developer conveyance body is a predetermined thickness in which the the developer layer does not come into contact with the surface of the latent image carrier (FIG. 15). Further, the smoothing member can be used as a developer smoothing means which is provided for contacting with the developer at the upstream side of the magnet pole provided in the developer conveyance body in such a manner that the magnet pole is opposite to the developing area, and between two magnet poles having the same polarity as the above-described pole (FIGS. 16(*a*) and 16(*b*)). Further, the smoothing member can be used as the developer smoothing means which is also used for the developer regulation means for regulating a passage amount of the developer which is provided at a predetermined gap with respect to the surface of the developer conveyance body, wherein the developer regulation means is provided opposite to another upstream magnetic pole having the same polarity as that of the magnet pole provided in the developer conveyance body in such a manner that the magnet pole is opposite to the developing area (FIGS. 16(*a*) and 16(*b*)).

In order to exhibit the functions of the developer smoothing member, it is necessary that the developer smoothing member is provided so that it is in pressure-contact with the developer on the developer conveyance body at the upstream side of the developing area which is enclosed in the image forming body and developer conveyance body provided opposite to the image forming body, or at the upstream side of the developer conveyance direction of the developer conveyance body.

More specifically, in order to exhibit the effect of the smoothing member at the developing area or just before the developing area, the following method is effective in which: one end of the smoothing member is fixed at the upstream side of the developing space (that is, developing area), in which development is mainly carried out, with respect to the developer conveyance direction of the developer conveyance body; the smoothing member is provided so that the other end of the smoothing member is positioned in the developing area or at the upstream side of the developing area, and so that the smoothing member is in pressure-contact with the developer on the developing carrier while this end is directed toward the downstream side. By this method, the smoothing member can be accurately located. This is very advantageous for conveying a uniform and high density developer layer to the developing area.

The developer smoothing member according to the present invention may be used in the structure of the developing unit in which the developer smoothing member is jointly used with the developer charging member. In this case, the developer with which the developer smoothing member is in pressure-contact, is charged by triboelectricity with this smoothing member.

The developer used here may be a two-component developer composed of toner and magnetic particles, or may be a magnetic or non-magnetic one-component developer.

The developer smoothing member according to the present invention is pressed with a force of 0.1 through 100 g/cm, preferably 0.5 through 50 g/cm, perpendicular to the developer conveyance direction of the developer conveyance body.

The developer smoothing member according to the present invention is worn out due to friction when it comes into direct contact with the developer. Further, under such a condition, the pressing force is gradually reduced by this permanent deformation.

The present inventors found that: when the developer smoothing member is composed of a resin reinforced with organic or inorganic fibre having a tensile strength of more than $8\times10^2$ kg/cm$^2$ and a modulus of elasticity for bending of more than 5×104 kg/cm$^2$ in the case of the generally used thickness of 20 through 500 μm, more preferably 20 through 200 μm, and the free length of 2 through 50 mm, more preferably 5 through 20 mm, then, the amount of abrasion of the contact surface with the developer is small, a large pressing force can be used at a small amount of displacement, and the smoothing member can be stably operated for a long period of time.

Figure 17:
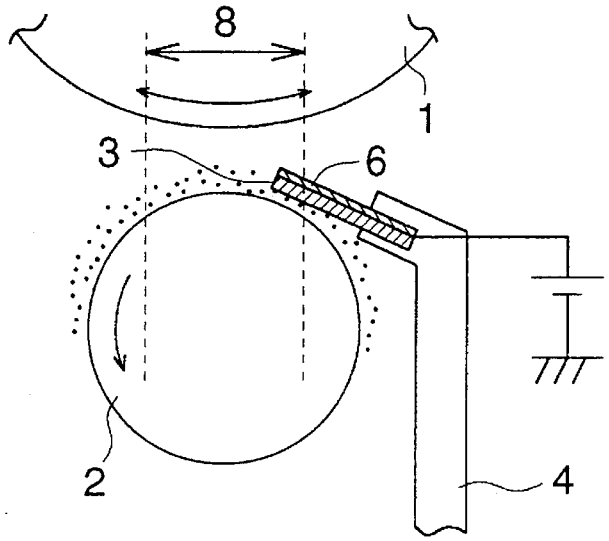
FIG. 17 is a view showing an outline of an embodiment of a developer smoothing member which is also used for a control electrode of the present invention.
Figure 18:
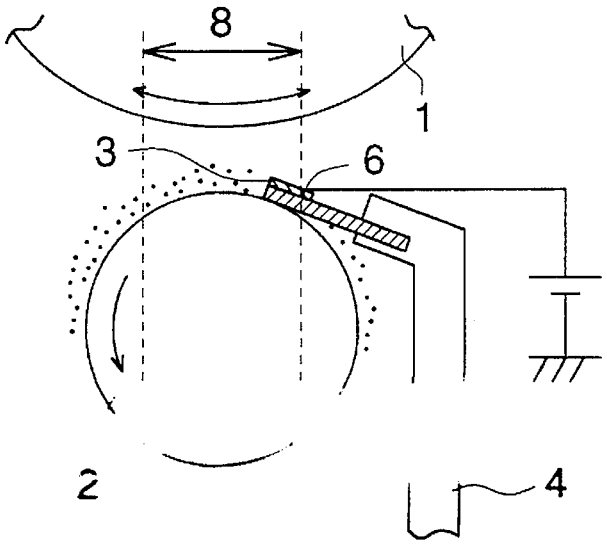
FIG. 18 is a view showing an outline of an embodiment of a developer smoothing member which is also used for a control electrode of the present invention.

In the case of the control electrode member for the developing unit, the control electrode member has been disclosed in Japanese Patent Publication open to Public Inspection Nos. 131878/1991, and 303377/1993. That is, as disclosed in Japanese Patent Publication open to Public Inspection No. 131878/1991, the control electrode member is in contact with the developer on the developer conveyance body, and is provided so that its end portion is positioned at the developing area (FIG. 17). In this case, the variable electric field is applied between the control electrode member and developer conveyance body. Further as disclosed in Japanese Patent Publication open to Public Inspection No. 303377/1993, the control electrode member is provided in such a manner that the insulation member is in contact with developer conveyance body on the upstream side of the developing area, and the electrode member is provided only on the downstream side in the developer conveyance direction with respect to the contact position of the insulation member (FIG. 18). In this case, the length of the electrode portion is preferably 0.01 through 2 mm in the developer conveyance direction. Also, in this case, the variable electric field is impressed between the control electrode member and the developer conveyance body.

Figure 19:
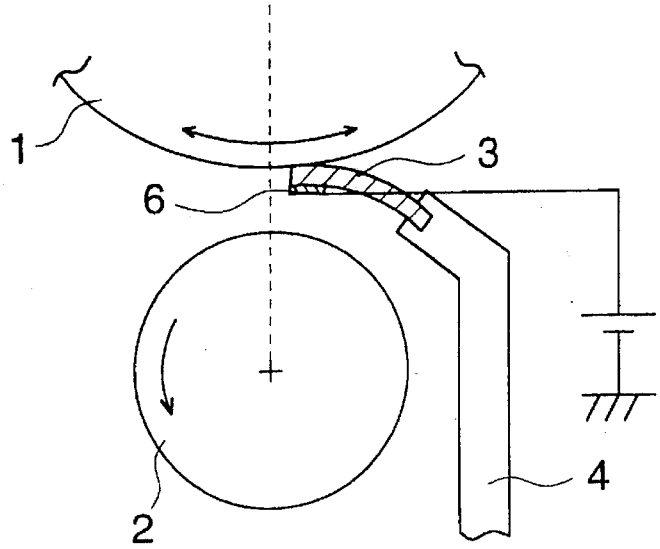
FIG. 19 is a view showing an embodiment of the control electrode member which is in contact with an image forming body of the present invention.

On the contrary to the above prior art, the control electrode member according to the present invention may be provided in such a manner that it is contacted with the image forming body as shown in FIG. 19. In the control electrode member composed of the insulation member and the electrode member, it is preferable that the insulation member is in contact with the image forming body.

When the control electrode member closes the downstream side of the developing area, which is enclosed by the image forming body and the opposing developer conveyance body, or the downstream side of the developer conveyance direction of the developer conveyance body, then the developing efficiency is greatly decreased, or the developer scatters over the space formed between the developer conveyance body and the image forming body or the developer conveyance body and the electrode, which is disadvantageous. Accordingly, when the control electrode member is provided in such a manner that the electrode member is in pressure-contact with the developer on the developer conveyance body, it is necessary that the electrode member is provided in such a manner that it is in pressure-contact with the developer on the developer conveyance body on the upstream side of the developing area or the developer conveyance direction. Further, even when the electrode member is provided so as to be in pressure-contact with the image forming body, it is not preferable that the control electrode member also closes the downstream side of the developing area or the developer conveyance direction of the developing carrier.

Further, when the control electrode member is provided in such a manner that it is in pressure-contact with the developer on the developer conveyance body, and more specifically, when one end of the control electrode member is fixed at the upstream side of the developing space (that is, developing area), in which mainly development is carried out, with respect to the developer conveyance direction of the developing carrier, and the other end of the control electrode member is provided in such a manner that it is in pressure-contact with the developer on the developer conveyance body and positioned in the developing area while this end is directed toward the downstream side, then, the developing efficiency is not lowered, toner does not scatter, and the control electrode member can be accurately installed, which is especially advantageous.

When the control electrode member is provided in such a manner that it is in pressure-contact with the image forming body, and more specifically, when the control electrode member is provided in such a manner that one end of the control electrode member is fixed at the upstream side or downstream side of the developing space (that is, developing area), in which development is mainly carried out, with respect to the rotational direction of the image forming body, and the other end of the control electrode member is provided in such a manner that it is in pressure-contact with the image forming body and positioned in the developing area while this end is directed toward the downstream side or the upstream side of the developing space, then, the control electrode member can be accurately installed. Also, in this case, it is preferable that the fixed one end is positioned on the upstream side with respect to the developer conveyance direction of the developer conveyance body.

It is necessary that the free end of the control electrode member is positioned in the developing area when the control electrode member comes into pressure-contact with the developer on the developer conveyance body, and also when it is in pressure-contact with the image forming body. In this case, of course, it is not preferable that almost all of the developing area is closed by the control electrode member.

It is preferable that an AC power source is connected to the developer conveyance body side and an AC voltage is impressed so that the developer is forced over the control electrode, and the latent image on the image forming body is effectively developed, when an variable electric field is impressed between the control electrode member and the developer conveyance body Of courser a DC bias electric field may be appropriately impressed among the developer conveyance body, control electrode member, and the image forming body.

Figure 20A:
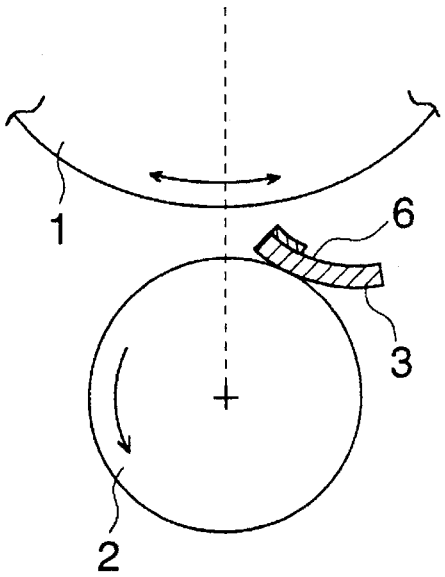
FIGS. 20(*a*) and 20(*b*) are views showing an embodiment of the arrangement of the control electrode member of the present invention.
Figure 20B:
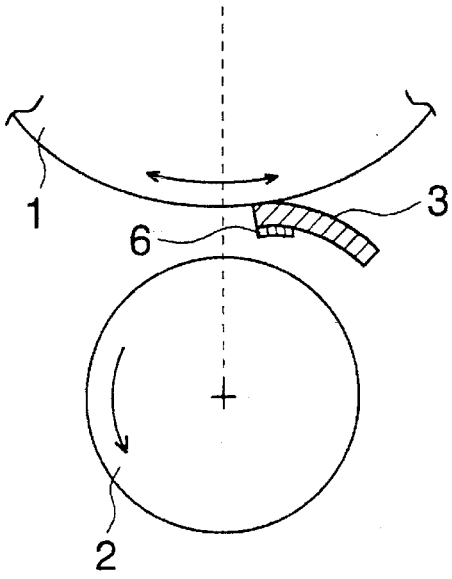
Figure 21A:
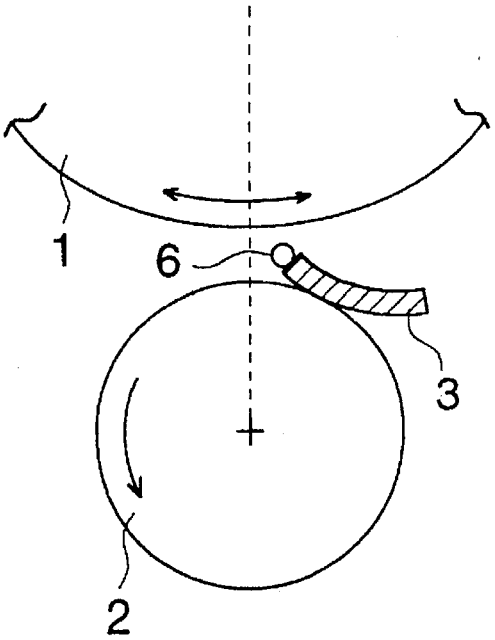
FIGS. 21(*a*) and 21(*b*) are views showing an embodiment of the arrangement of the control electrode member of the present invention.
Figure 21B:
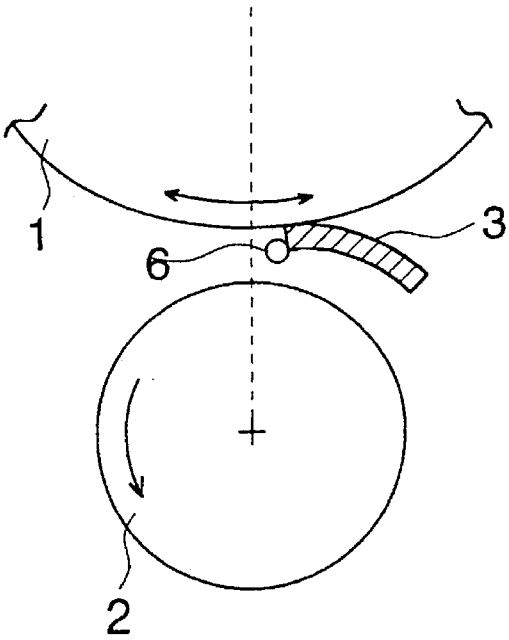

The electrode member may be provided on the surface opposite to the pressure surface of the insulation member with respect to the developer on the developer conveyance body or the image forming body (FIGS. 20(*a*) and 20(*b*)). Also, the electrode member may be provided on the end surface of the insulation member (FIGS. 21(*a*) and 21(*b*)). Further, when an insulation coating layer is provided on the electrode member which is positioned on the insulation member, the electrode member may be provided on the pressure surface of the insulation member with respect to the developer conveyance body or the image forming body.

As disclosed in Japanese Patent Publication Open to Public Inspection No. 131878/1991, the control electrode member of the present invention may be used in the structure of the developing unit in which the control electrode member is jointly used with a developer conveyance amount regulation member or a developer charging mender.

Further, the control electrode member may be used in the structure of the developing unit in which the control electrode member is also used with the developer smoothing member.

Here, the developer used in the developing unit may be two-component developer composed of toner and magnetic particles, or magnetic or non-magnetic one-component developer.

The control electrode member of the present invention is pressed with a force of 0.1 through 100 g/cm, preferably 0.5 through 50 g/cm with respect to the direction perpendicular to the developer conveyance direction of the developer conveyance body or the rotational direction of the image forming body.

The control electrode member of the present invention is directly in contact with the developer or the image forming body and is abraded by the friction due to the pressure contact, including cases where the control electrode member is jointly used with the developer conveyance amount regulation member or developer charging member, or where the control electrode member is jointly used with the developer smoothing member. Further, there is a possibility that the pressing force is gradually decreased due to the permanent deformation in the above pressing conditions, and therefore pressure conditions change. Due to the above reasons, there is a possibility that the relative positional relationship among the developer conveyance body, control electrode member and the image forming body changes, or the developer conveyance amount, developer charging amount, and effects due to developer smoothing.

The present inventors found that: when the insulation member for composing the control electrode member is composed of resins reinforced with organic or inorganic fibre having a tensile strength of more than $8\times10^2$ kg/cm$^2$ and a modulus of elasticity for bending of more than 5×104 kg/cm$^2$ in the case of the generally used thickness of 20 through 500 μm, more preferably 20 through 200 μm, and a free length of 2 mm through 50 mm, more preferably 5 through 20 mm, then, a large pressing force can be exerted with a small amount of displacement, the relative positional relationship among the developer conveyance body, control electrode member and image forming body is not changed, the control electrode member can be operated stably for a long period of time.

EXAMPLES

The invention will be explained concretely as follows, referring to the following examples to which the invention is not naturally limited.

EXAMPLE 1

A smoothing member having a thickness of 150 μm, a tensile strength of 1750 kg/cm$^2$ and a modulus of elasticity for bending of $7.6\times10^4$ kg/cm$^2$ prepared by compression-forming nylon 6 containing 30% by weight of GF (glass fiber) was installed in Konica 9028 (made by Konica Corp.) wherein a developer layer regulating member was changed to a doctor blade which is represented by a gap of 125 μm from a developer conveyance roller, under the conditions of r=10 mm, $l_1$=10 mm, $l_2$=4 mm, d=0.5 mm, $\theta_5$=0°, $\theta_6$=15° and $\theta_7$=15°, all in FIGS. 22(*a*) and 22(*b*). Further, $\theta_5$: an angle formed between a line, by which the center of the sleeve is connected to a layer thickness regulating member, and the nearest magnetic pole.

$\theta_6$: an angle formed between a line, by which the center of the sleeve is connected to the closest position between the sleeve and the photoreceptor, and the magnet pole adjoining the upstream side of the closest position.

$\theta_7$: an angle formed between a line, by which the center of the sleeve is connected to the closest position between the sleeve and the photoreceptor, and the magnet pole adjoining the downstream side of the closest position.

$l_1$: the free length of the control electrode $l_2$: the horizontal distance formed between a cross point, at which the extended line of the fixing member crosses with the sleeve (in the case of $l_2'$, crosses with the photoreceptor), and the closest position d: the horizontal distance formed between the closest position and the end of the control electrode r: the radius of the developing sleeve A developer that is exclusive for Konica 9028 was used without changing it except that $\sigma_{1000}$ of a developer carrier of the developer was changed from normal 18 emu/g to 25 emu/g.

In the performance test, no deterioration of image quality was observed even after making 50,000 copies continuously.

Comparative Example 1

A smoothing member having a thickness of 150 μm, a tensile strength of 710 kg/cm$^2$ and a modulus of elasticity for bending of $2.45\times10^4$ kg/cm$^2$ prepared by compression-forming nylon 6 was installed in Konica 9028 wherein a developer layer regulating member was changed to a doctor blade which is represented by a gap of 125 μm from a developer conveyance roller, under the conditions of r=10 mm, $l_1$=10 mm, $l_2$=4 mm, d=0.5 mm, $\theta_5$=0°, $\theta_6$=15° and $\theta_7$=15°, all in FIGS. 22(*a*) and (*b*).

A developer that is exclusive for Konica 9028 was used without changing it except that $\sigma_{1000}$ of a developer carrier of the developer was changed from normal 18 emu/g to 25 emu/g.

After making 15,000 copies continuously, insufficient smoothing of a developer layer caused, at the level of 50 particles/mm$^2$ in terms of black toner, the so-called mixing of color that is represented by black toner sticking on an image area to which the black toner should not stick under a normal condition.

EXAMPLE 2

A smoothing member having a thickness of 150 μm, a tensile strength of 1250 kg/cm$^2$ and a modulus of elasticity for bending of 7.5×10$^4$ kg/cm$^2$ prepared by compression-forming polyacetal containing 25% by weight of GF was installed in Konica 9028 wherein a developer layer regulating member was changed to a doctor blade which is represented by a gap of 175 μm from a developer conveyance roller, under the conditions of r=10 mm, $l_1$=10 mm, $l_2$=4 mm, d=1 mm, $\theta_5$=0°, $\theta_6$=0° and $\theta_7$=60°, all in FIGS. 22(*a*) and 22(*b*).

A developer that is exclusive for Konica 9028 was used without changing it except that $\sigma_{1000}$ of a developer carrier of the developer was changed from normal 18 emu/g to 25 emu/g. As a result, no deterioration of image quality was observed even after making 50,000 copies continuously.

Comparative Example 2

A smoothing member having a thickness of 150 μm, a tensile strength of 590 kg/cm$^2$ and a modulus of elasticity for bending of 2.5×10$^4$ kg/cm$^2$ prepared by compression-forming polyacetal was installed in Konica 9028 wherein a developer layer regulating member was changed to a doctor blade which is represented by a gap of 175 μm from a developer conveyance roller, under the conditions of r=10 mm, $l_1$=10 mm, $l_2$=4 mm, d=1 mm, $\theta_5$=0°, $\theta_6$=0° and $\theta_7$=60°, all in FIGS. 22(*a*) and 22(*b*).

A developer that is exclusive foe Konica 9028 was used without changing it except that $\sigma_{1000}$ of a developer carrier of the developer was changed from normal 18 emu/g to 25 emu/g.

In the continuous copy test, mixing of color was observed from the beginning. In observation through high speed video, it was observed that a developer layer on a developing unit for black came into contact with a photoreceptor due to insufficient stiffness of the smoothing member.

EXAMPLE 3

A smoothing member having a thickness of 100 μm, a tensile strength of 2850 kg/cm$^2$ and a modulus of elasticity for bending of 27×10$^4$ kg/cm$^2$ prepared by press-molding, under the conditions of 160° C. and 70 kg/cm$^2$, the prepreg obtained by impregnating bisphenol A type epoxy resin varnish (using methyl ethyl ketone solvent) of epoxy equivalent 480 containing an appropriate amount of dicyandiamide as a hardener in plain weave glass cloth layer made of E-glass subjected to γ-aminopropyltrimethoxy silane processing so that weight of the product therein may occupy 50%, was installed in Konica 9028 wherein a developer layer regulating member was changed to a doctor blade which is represented by a gap of 125 μm from a developer conveyance roller, under the conditions of r=10 mm, $l_1$=10 mm, $l_2$=4 mm, d=0.5 mm, $\theta_5$=0°, $\theta_6$=0° and $\theta_7$=30°, all in FIGS. 22(*a*) and 22(*b*).

A developer that is exclusive for Konica 9028 was used without changing it except that $\sigma_{1000}$ of a developer carrier of the developer was changed from normal 18 emu/g to 25 emu/g.

In the performance test, no deterioration of image quality was observed even after making 50,000 copies continuously.

Comparative Example 3

A smoothing member having a thickness of 100 μm, a tensile strength of 910 kg/cm$^2$ and a modulus of elasticity for bending of 1.6×10$^4$ kg/cm$^2$ prepared by transfer-forming the same material as in Example 3 except that no glass cloth is contained was installed in Konica 9028 wherein a developer layer regulating member was changed to a doctor blade which is represented by a gap of 125 μm from a developer conveyance roller, under the conditions of r=10 mm, $l_1$=10 mm, $l_2$=4 mm, d=0.5 mm, $\theta_5$=0°, $\theta_6$=0° and $\theta_7$=30°, all in FIGS. 22(*a*) and 22(*b*).

A developer that is exclusive for Konica 9028 was used without changing it except that $\sigma_{1000}$ of a developer carrier of the developer was changed from normal 18 emu/g to 25 emu/g.

After making 4,000 copies continuously, insufficient smoothing of a developer layer caused, at the level of 50 particles/mm$^2$ in terms of black toner, the so-called mixing of color that is represented by black toner sticking on an image area to which the black toner should not stick under a normal condition.

EXAMPLE 4

A smoothing member having a thickness of 100 μm, a tensile strength of 3100 kg/cm$^2$ and a modulus of elasticity for bending of 26×10$^4$ kg/cm$^2$ prepared by press-molding, under the conditions of 190° C. and 50 kg/cm$^2$ after keeping for 2 hours, the prepreg obtained by soaking, to get 50% by weight of formed products, a plain weave glass cloth layer made of E-glass processed in advance with N-β-aminoethyl-γ-aminopropyltrimethoxy silane in varnish having 50% by weight concentration wherein polyaminobismaleimide (made by Kerimid 601—Rhone Poulenc Co.) is dissolved in N-methylpyrrolidone, and by drying at 150° C. for 15 minutes, was installed in Konica 9028 wherein a developer layer regulating member was changed to a doctor blade which is represented by a gap of 125 μm from a developer conveyance roller, under the conditions of r=10 mm, $l_1$=10 mm, $l_2$=4 mm, d=1.5 mm, $\theta_5$=0°, $\theta_6$=0° and $\theta_7$=30°, all in FIGS. 22(*a*) and 22(*b*).

A developer that is exclusive for Konica 9028 was used without changing it except that $\sigma_{1000}$ of a developer carrier of the developer was changed from normal 18 emu/g to 25 emu/g.

In the performance test, no deterioration of image quality was observed even after making 50,000 copies continuously.

Comparative Example 4

A smoothing member having a thickness of 100 μm, a tensile strength of 1200 kg/cm$^2$ and a modulus of elasticity for bending of 3.5×10$^4$ kg/cm$^2$ prepared by press-molding, under the conditions of 350° C. and 800 kg/cm$^2$, polybenzophenonetetra carboxylic acid imido (PI 2080-Upjohn Co. benzophenontetra carboxylic acid/methylenedianiline/toluylenediamine condensed product) was installed in Konica 9028 wherein a developer layer regulating member was changed to a doctor blade which is represented by a gap of 125 μm from a developer conveyance roller, under the conditions of r=10 mm, $l_1^{10}$ mm, $l_2$=4 mm, d=1.5 mm, $\theta_5$=0°, $\theta_6$=0° and $\theta_7$=30°, all in FIGS. 22(*a*) and 22(*b*).

A developer that is exclusive for Konica 9028 was used without changing it except that $\sigma_{1000}$ of a developer carrier of the developer was changed from normal 18 emu/g to 25 emu/g.

After making 7,000 copies continuously, insufficient smoothing of a developer layer caused, at the level of 50 particles/mm$^2$ in terms of black toner, the so-called mixing of color that is represented by black toner sticking on an image area to which the black toner should not stick under a normal condition.

EXAMPLE 5

A smoothing member having a thickness of 150 μm, a tensile strength of 950 kg/cm$^2$ and a modulus of elasticity for bending of 5.5×10$^4$ kg/cm$^2$ prepared by compression-forming denatured polyphenyleneoxide (NC 208-GE Co., containing 8% by weight of carbon fiber) was installed in Konica 9028 wherein a developer layer regulating member was changed to a doctor blade which is represented by a gap of 125 μm from a developer conveyance roller, under the conditions of r=10 mm, $l_1$=10 mm, $l_2$=4 mm, d=0.5 mm, $\theta_5$=0°, $\theta_6$=0° and $\theta_7$=30°, all in FIGS. 22(*a*) and 22(*b*).

A developer that is exclusive for Konica 9028 was used without changing it except that $\sigma_{1000}$ of a developer carrier of the developer was changed from normal 18 emu/g to 25 emu/g.

In the performance test, no deterioration of image quality was observed even after making 30,000 copies continuously.

Comparative Example 5

A smoothing member having a thickness of 150 μm, a tensile strength of 760 kg/cm$^2$ and a modulus of elasticity for bending of 15×10$^4$ kg/cm$^2$ prepared by compression-forming polyphenylenesulfide resin compound (RAITON R-9, containing glass fiber and inorganic filler) was installed in Konica 9028 wherein a developer layer regulating member was changed to a doctor blade which is represented by a gap of 125 μm from a developer conveyance roller, under the conditions of r=10 mm, $l_1$=10 mm, $l_2$=4 mm, d=0.5 mm, $\theta_5$=0°, $\theta_6$=0° and $\theta_7$=30°, all in FIGS. 22(*a*) and 22(*b*).

A developer that is exclusive for Konica 9028 was used without changing it except that $\sigma_{1000}$ of a developer carrier of the developer was changed from normal 18 emu/g to 25 emu/g.

After making 18,000 copies continuously, wear on a portion where a smoothing member is in contact with a developer conveyance body was observed and insufficient smoothing of a developer layer caused, at the level of 50 particles/mm$^2$ in terms of black toner, the so-called mixing of color that is represented by black toner sticking on an image area to which the black toner should not stick under a normal condition.

EXAMPLE 6

A smoothing member having a thickness of 150 μm, a tensile strength of 1200 kg/cm$^2$ and a modulus of elasticity for bending of 5×10$^4$ kg/cm$^2$ prepared by compression-forming nylon 66 containing 20% by weight of Kevler (Kevler long-fiber reinforced resin AC pellet-AISHIN KAKO Co.) was installed in Konica 9028 wherein a developer layer regulating member was changed to a doctor blade which is represented by a gap of 125 μm from a developer conveyance roller, under the conditions of r=10 mm, $l_1$=10 mm, $l_2$=4 mm, d=0.5 mm, $\theta_5$=0°, $\theta_6$=15° and $\theta_7$=15°, all in FIGS. 22(*a*) and 22(*b*).

A developer that is exclusive for Konica 9028 was used without changing it except that $\sigma_{1000}$ of a developer carrier of the developer was changed from normal 18 emu/g to 25 emu/g.

In the performance test, no deterioration of image quality was observed even after making 30,000 copies continuously.

EXAMPLE 7

A control electrode member was prepared by sticking a 10-μm-thick electrolytic copper foil on the surface of an insulating member having a thickness of 150 μm, a tensile strength of 1750 kg/cm$^2$ and a modulus of elasticity for bending of 7.6×10$^4$ kg/cm$^2$ prepared by compression-forming nylon 6 containing 30% by weight of GF through a 10-μm-thick epoxy adhesive layer, and by leaving a 1-mm-wide electrode member only on a tip portion thereof through etching. This control electrode member was installed in Konica 9028 wherein a developer layer regulating member was changed to a doctor blade which is represented by a gap of 125 μm from a developer conveyance roller, under the conditions of r=10 mm, $l_1$=9 mm, $l_2$=4 mm, d=1.5 mm, $\theta_5$=0°, $\theta_6$=30° and $\theta_7$=30° , all in FIGS. 23(*a*) and 23(*b*).

Photoreceptor surface potential on a white background portion was set to −850 V, D.C. voltage for a control electrode was set to −750 V, impressed D.C. voltage for a developer conveyance body (developing roller) was set to −750 V, frequency of A.C. bias voltage impressed between the developer conveyance body and the control electrode was set to 8 kHz and its voltage was set to 1.7 $kV_{p-p}$.

A developer that is exclusive for Konica 9028 was used without changing it except that $\sigma_{1000}$ of a developer carrier of the developer was changed from normal 18 emu/g to 25 emu/g.

In the performance test, no deterioration of image quality was observed even after making 50,000 copies continuously.

Comparative Example 6

A control electrode member was prepared by sticking a 10-μm-thick electrolytic copper foil on the surface of an insulating member having a thickness of 150 μm, a tensile strength of 710 kg/cm$^2$ and a modulus of elasticity for bending of 2.45×10$^4$ kg/cm$^2$ prepared by compression-forming nylon 6 through a 10-μm-thick epoxy adhesive layer, and by leaving a 1-mm-wide electrode member only on a tip portion thereof through etching. This control electrode member was installed in Konica 9028 wherein a developer layer regulating member was changed to a doctor blade which is represented by a gap of 125 μm from a developer conveyance roller, under the conditions of r=10 mm, $l_1$=9 mm, $l_2$=4 mm, d=1.5 mm, $\theta_5$=0°, $\theta_6$=30° and $\theta_7$=30° , all in FIGS. 23(*a*) and 23(*b*).

Photoreceptor surface potential on a white background portion was set to −850 V, D.C. voltage for a control electrode was set to −750 V, impressed D.C. voltage for a developer conveyance body (developing roller) was set to −750 V, frequency of A.C. bias voltage impressed between the developer conveyance body and the control electrode was set to 8 kHz and its voltage was set to 1.7 $kV_{p-p}$.

A developer that is exclusive for Konica 9028 was used without changing it except that $\sigma_{1000}$ of a developer carrier of the developer was changed from normal 18 emu/g to 25 emu/g.

After making 10,000 copies continuously, wear on the control electrode member and insufficient smoothing of a developer layer were observed, and they caused, at the level of 150 particles/mm$^2$ in terms of black toner, the so-called mixing of color that is represented by black toner sticking on an image area to which the black toner should not stick under a normal condition.

EXAMPLE 8

A control electrode member was prepared by sticking a 20-μm-thick electrolytic copper foil on the surface of an insulating member having a thickness of 150 μm, a tensile strength of 1250 kg/cm$^2$ and a modulus of elasticity for bending of 7.5×10$^4$ kg/cm$^2$ prepared by compression-forming polyacetal containing 25% by weight of GF through a 15-μm-thick epoxy adhesive layer, and by leaving a 500-μm-wide electrode member only on a tip portion thereof through etching.

This control electrode member was installed in Konica 9028 wherein a developer layer regulating member was changed to a doctor blade which is represented by a gap of 175 μm from a developer conveyance roller, under the conditions of r=10 mm, $l_1$=10 mm, $l_2$=4 mm, d=1 mm, $\theta_5$=0°, $\theta_6$=0° and $\theta_7$=60°, all in FIGS. 23(*a*) and 23(*b*).

Photoreceptor surface potential on a white background portion was set to −850 V, D.C. voltage for a control electrode was set to −750 V, impressed D.C. voltage for a developer conveyance body (developing roller) was set to −750 V, frequency of A.C. bias voltage impressed between the developer conveyance body and the control electrode was set to 8 kHz and its voltage was set to 1.7 kV$_{p-p}$.

A developer that is exclusive for Konica 9028 was used without changing it except that $\sigma_{1000}$ of a developer carrier of the developer was changed from normal 18 emu/g to 25 emu/g.

In the performance test, no deterioration of image quality was observed even after making 50,000 copies continuously.

Comparative Example 7

A control electrode member was prepared by sticking a 20-μm-thick electrolytic copper foil on the surface of an insulating member having a thickness of 150 μm, a tensile strength of 590 kg/cm$^2$ and a modulus of elasticity for bending of 2.5×10$^4$ kg/cm$^2$ prepared by compression-forming polyacetal through a 15-μm-thick epoxy adhesive layer, and by leaving a 500-μm-wide electrode member only on a tip portion thereof through etching.

This control electrode member was installed in Konica 9028 wherein a developer layer regulating member was changed to a doctor blade which is represented by a gap of 175 μm from a developer conveyance roller, under the conditions of r=10 mm, $l_1$=10 mm, $l_2$=4 mm, d=1 mm, $\theta_5$=0°, $\theta_6$=0° and $\theta_7$=60°, all in FIGS. 23(*a*) and 23(*b*).

Photoreceptor surface potential on a white background portion was set to −850 V, D.C. voltage for a control electrode was set to −750 V, impressed D.C. voltage for a developer conveyance body (developing roller) was set to −750 V, frequency of A.C. bias voltage impressed between the developer conveyance body and the control electrode was set to 8 kHz and its voltage was set to 1.7 kV$_{p-p}$.

A developer that is exclusive for Konica 9028 was used without changing it except that $\sigma_{1000}$ of a developer carrier of the developer was changed from normal 18 emu/g to 25 emu/g.

As a result of a performance test, mixing of color was observed from the beginning. In observation through high speed video, it was observed that a developer layer on a developing unit came into contact with a photoreceptor due to insufficient stiffness of the control electrode member.

EXAMPLE 9

A member having a thickness of 120 μm was prepared by forming, under the conditions of 160° C. and 70 kg/cm$^2$, the prepreg obtained by impregnating bisphenol A type epoxy resin varnish (using methyl ethyl ketone solvent) of epoxy equivalent 480 containing an appropriate amount of dicyandiamide as a hardener in plain weave glass cloth layer made of E-glass subjected to γ-aminopropyltrimethoxy silane processing, together with a 20-μm-thick electrolytic copper foil superimposed on the prepreg, so that weight of the product therein may occupy 50%. A 100-μm-thick member obtained under the same conditions except that the electrolytic copper foil was not laminated showed a tensile strength of 2850 kg/cm$^2$ and a modulus of elasticity for bending of 27×10$^4$ kg/cm$^2$. A control electrode member obtained by leaving a 500-μm-wide electrode member only on a tip portion thereof through etching was installed in Konica 9028 wherein a developer layer regulating member was changed to a doctor blade which is represented by a gap of 125 μm from a developer conveyance roller, under the conditions of r=10 mm, $l_1$=10 mm, $l_2$=4 mm, d=0.5 mm, $\theta_5$=0°, $\theta_6$=0° and $\theta_7$=30°, all in FIGS. 23(*a*) and 23(*b*).

Photoreceptor surface potential on a white background portion was set to −850 V, D.C. voltage for a control electrode was set to −750 V, impressed D.C. voltage for a developer conveyance body (developing roller) was set to −750 V, frequency of A.C. bias voltage impressed between the developer conveyance body and the control electrode was set to 8 kHz and its voltage was set to 1.7 kV$_{p-p}$.

A developer that is exclusive for Konica 9028 was used without changing it except that $\sigma_{1000}$ of a developer carrier of the developer was changed from normal 18 emu/g to 25 emu/g. In the performance test, no deterioration of image quality was observed even after making 50,000 copies continuously.

Comparative Example

A member having a thickness of 85 μm, a tensile strength of 910 kg/cm$^2$ and a modulus of elasticity for bending of 1.6×10$^4$ kg/cm$^2$ was prepared by transfer-forming the same material as in Example 8 except that no glass cloth was contained then, a control electrode member was prepared by sticking a 20-μm-thick electrolytic copper foil on the above-mentioned member through a 15-μm-thick epoxy adhesive layer, and by leaving a 500-μm-wide electrode member only on a tip portion thereof through etching. This control electrode member was installed in Konica 9028 wherein a developer layer regulating member was changed to a doctor blade which is represented by a gap of 125 μm from a developer conveyance roller, under the conditions of r=10 mm, $l_1$=10 mm, $l_2$=4 mm, d=0.5 mm, $\theta_5$=0°, $\theta_6$=0° and $\theta_7$=30°, all in FIGS. 23(*a*) and 23(*b*).

Photoreceptor surface potential on a white background portion was set to −850 V, D.C. voltage for a control electrode was set to −750 V, impressed D.C. voltage for a developer conveyance body (developing roller) was set to −750 V, frequency of A.C. bias voltage impressed between the developer conveyance body and the control electrode was set to 8 kHz and its voltage was set to 1.7 $kV_{p-p}$.

A developer that is exclusive for Konica 9028 was used without changing it except that $\sigma_{1000}$ of a developer carrier of the developer was changed from normal 18 emu/g to 25 emu/g.

After making 3,000 copies continuously, insufficient smoothing of a developer layer caused, at the level of 50 particles/$mm^2$ in terms of black toner, the so-called mixing of color that is represented by black toner sticking on an image area to which the black toner should not stick under a normal condition.

EXAMPLE 10

A member having a thickness of 112 μm was prepared by press-molding, together with a 12-μm-thick electrolytic copper foil laminated, under the conditions of 190° C. and 50 kg/$cm^2$ after keeping for 2 hours, the prepreg obtained by soaking, to get 50% by weight of formed products, a plain weave glass cloth layer made of E-glass processed in advance with N-β-aminoethyl-γ-aminopropyltrimethoxy silane in varnish having 50% by weight concentration wherein polyaminobismaleimide (made by Kerimid 601—Rhone Poulenc Co.) is dissolved in N-methylpyrrolidone, and by drying at 150° C. for 15 minutes. A 100-μm-thick member obtained under the same conditions except that the electrolytic copper foil was not laminated showed a tensile strength of 3100 kg/$cm^2$ and a modulus of elasticity for bending of $26\times10^4$ kg/$cm^2$. A control electrode member obtained by leaving a 500-μm-wide electrode member only on a tip portion thereof through etching was installed in Konica 9028 wherein a developer layer regulating member was changed to a doctor blade which is represented by a gap of 125 μm from a developer conveyance roller, under the conditions of r=10 mm, $l_1$=10 mm, $l_2$=4 mm, d=0.5 mm, $\theta_5$=0°, $\theta_6$=0° and $\theta_7$=30°, all in FIGS. 23(*a*) and 23(*b*).

Photoreceptor surface potential on a white background portion was set to −850 V, D.C. voltage for a control electrode was set to −750 V, impressed D.C. voltage for a developer conveyance body (developing roller) was set to −750 V, frequency of A.C. bias voltage impressed between the developer conveyance body and the control electrode was set to 8 kHz and its voltage was set to 1.7 $kV_{p-p}$.

A developer that is exclusive for Konica 9028 was used without changing it except that $\sigma_{1000}$ of a developer carrier of the developer was changed from normal 18 emu/g to 25 emu/g. In the performance test, no deterioration of image quality was observed even after making 50,000 copies continuously.

Comparative Example 9

A member having a thickness of 112 μm was prepared by press-molding, under the conditions of 350° C. and 800 kg/$cm^2$, polybenzophenonetetra carboxylic acid imido (PI 2080-Upjohn Co. benzophenonetetra carboxylic acid/methylenedianiline/toluylenediamine condensed product) together with a 12-μm-thick electrolytic copper foil laminated. A 100-μm-thick member obtained under the same conditions except that the electrolytic copper foil was not laminated showed a tensile strength of 1200 kg/$cm^2$ and a modulus of elasticity for bending of $3.5\times10^4$ kg/$cm^2$. A control electrode member obtained by leaving a 500-μm-wide electrode member only on a tip portion thereof through etching was installed in Konica 9028 wherein a developer layer regulating member was changed to a doctor blade which is represented by a gap of 125 μm from a developer conveyance roller, under the conditions of r=10 nm, $l_1$=10 mm, $l_2$=4 mm, d=0.5 mm, $\theta_5$=0°, $\theta_6$=0° and $\theta_7$=30°, all in FIGS. 23(*a*) and 23(*b*).

Photoreceptor surface potential on a white background portion was set to −850 V, D.C. voltage for a control electrode was set to −750 V, impressed D.C. voltage for a developer conveyance body (developing roller) was set to −750 V, frequency of A.C. bias voltage impressed between the developer conveyance body and the control electrode was set to 8 kHz and its voltage was set to 1.7 $kV_{p-p}$.

A developer that is exclusive for Konica 9028 was used without changing it except that $\sigma_{1000}$ of a developer carrier of the developer was changed from normal 18 emu/g to 25 emu/g.

After making 8,000 copies continuously, excessive developing and the so-called mixing of color that is represented by black toner sticking on an image area to which the black toner should not stick under a normal condition were caused both by wear on a portion where the control electrode member is in contact with a developer and by insufficient smoothing of a developing unit.

EXAMPLE 11

A 20-μm-thick electrolytic copper foil was stuck on the surface of an insulating member having a thickness of 150 μm, a tensile strength of 950 kg/$cm^2$ and a modulus of elasticity for bending of $5.5\times10^4$ kg/$cm^2$ prepared by compression-forming denatured polyphenyleneoxide (NC 208-GE Co., containing 8% by weight of carbon fibers) through a 15-μm-thick epoxy adhesive layer, and thereby a control electrode member was obtained by leaving a 500-μm-wide electrode member only on the tip portion thereof by means of etching.

This control electrode member was installed in Konica 9028 wherein a developer layer regulating member was changed to a doctor blade which is represented by a gap of 125 μm from a developer conveyance roller, under the conditions of r=10 mm, $l_1$=10 mm, $l_2$=4 mm, d=1 mm, $\theta_5$=0°, $\theta_6$=0° and $\theta_7$=30°, all in FIGS. 23(*a*) and 23(*b*).

Photoreceptor surface potential on a white background portion was set to −850 V, D.C. voltage for a control electrode was set to −750 V, impressed D.C. voltage for a developer conveyance body (developing roller) was set to −750 V, frequency of A.C. bias voltage impressed between the developer conveyance body and the control electrode was set to 8 kHz and its voltage was set to 1.7 $kV_{p-p}$.

A developer that is exclusive for Konica 9028 was used without changing it except that $\sigma_{1000}$ of a developer carrier of the developer was changed from normal 18 emu/g to 25 emu/g.

In the performance test, no deterioration of image quality was observed even after making 30,000 copies continuously.

Comparative Example 10

A control electrode member which was obtained by sticking, through a 10-μm-thick epoxy adhesive layer, a 12-μm-thick electrolytic copper foil on the surface of an insulating member having a thickness of 150 μm, a tensile strength of 760 kg/$cm^2$ and a modulus of elasticity for bending of $15\times10^4$ kg/$cm^2$ prepared by compression-forming polyphenylenesulfide resin compound (RAITON R-9, containing glass fibers and inorganic fillers) and by leaving a 500-μm-wide electrode member only on the tip portion thereof through etching, was installed in Konica 9028 wherein a developer layer regulating member was changed to a doctor blade which is represented by a gap of 125 μm from a developer conveyance roller, under the conditions of r=10 mm, $l_1$=10 mm, $l_2$=4 mm, d=1 mm, $\theta_5$=0°, $\theta_6$=0° and $\theta_7$=30°, all in FIGS. 23(*a*) and 23(*b*).

A developer that is exclusive for Konica 9028 was used without changing it except that $\sigma_{1000}$ of a developer carrier of the developer was changed from normal 18 emu/g to 25 emu/g.

After making 12,000 copies continuously, excessive developing and the so-called mixing of color that is represented by black toner sticking on an image area to which the black toner should not stick under a normal condition were caused both by wear on a portion where the control electrode member is in contact with a developer and by insufficient smoothing of a developer layer.

EXAMPLE 12

A member having a thickness of 112 μm was prepared by press-molding, together with a 12-μm-thick electrolytic copper foil laminated, under the conditions of 190° C. and 50 kg/cm$^2$ after keeping for 2 hours, the prepreg obtained by soaking, to get 50% by weight of formed products, a plain weave glass cloth layer made of E-glass processed in advance with N-β-aminoethyl-γ-aminopropyltrimethoxy silane in varnish having 50% by weight concentration wherein polyaminobismaleimide (made by Kerimid 601—Rhone Poulenc Co.) is dissolved in N-methylpyrrolidone, and by drying at 150° C. for 15 minutes. A 100-μm-thick member obtained under the same conditions except that the electrolytic copper foil was not laminated showed a tensile strength of 3100 kg/cm$^2$ and a modulus of elasticity for bending of 26×10$^4$ kg/cm$^2$. A control electrode member obtained by leaving a 1-mm-wide electrode member only on a tip portion of the above-mentioned member through etching was installed in Konica 9028 wherein a developer layer regulating member was changed to a doctor blade which is represented by a gap of 125 μm from a developer conveyance roller, under the conditions of r=90 mm, $l_1$=15 mm, $l_2$=11.8 mm, d=0.5 mm, $\theta_5$=0°, $\theta_6$=0° and $\theta_7$=30°, all in FIGS. 24(*a*) and 24(*b*).

Photoreceptor surface potential on a white background portion was set to −850 V, D.C. voltage for a control electrode was set to −750 V, impressed D.C. voltage for a developer conveyance body (developing roller) was set to −750 V, frequency of A.C. bias voltage impressed between the developer conveyance body and the control electrode was set to 8 kHz and its voltage was set to 1.7 $kV_{p-p}$.

A developer that is exclusive for Konica 9028 was used without changing it except that $\sigma_{1000}$ of a developer carrier of the developer was changed from normal 18 emu/g to 25 emu/g. In the performance test, no deterioration of image quality was observed even after making 50,000 copies continuously.

Comparative Example 11

A member having a thickness of 112 μm was prepared by press-molding, under the conditions of 350° C. and 800 kg/cm$^2$, polybenzophenonetetra carboxylic acid imido (PI 2080-Upjohn Co. benzophenonetetra carboxylic acid/methylenedianiline/toluylenediamine condensed product) together with a 12-μm-thick electrolytic foil laminated. A 100-μm-thick member obtained under the same conditions except that the electrolytic copper foil was not laminated showed a tensile strength of 1200 kg/cm$^2$ and a modulus of elasticity for bending of 3.5×10$^4$ kg/cm$^2$. A control electrode member obtained by leaving a 1-mm-wide electrode member only on a tip portion of the above-mentioned member through etching was installed in Konica 9028 wherein a developer layer regulating member was changed to a doctor blade which is represented by a gap of 125 μm from a developer conveyance roller, under the conditions of r'=90 mm, $l_1$'=15 mm, $l_2$'=11.8 mm, d=0.5 mm, $\theta_5$=0°, $\theta_6$=0° and $\theta_7$=30°, all in FIGS. 24(*a*) and 24(*b*).

Photoreceptor surface potential on a white background portion was set to −850 V, D.C. voltage for a control electrode was set to −750 V, impressed D.C. voltage for a developer conveyance body (developing roller) was set to −750 V, frequency of A.C. bias voltage impressed between the developer conveyance body and the control electrode was set to 8 kHz and its voltage was set to 1.7 $kV_{p-p}$.

A developer that is exclusive for Konica 9028 was used without changing it except that $\sigma_{1000}$ of a developer carrier of the developer was changed from normal 18 emu/g to 25 emu/g. After making 16,000 copies continuously, there was observed a phenomenon that a tip of the control electrode member came in contact with a developer carrier from time to time, and there appeared irregularity of light and shade on the image.

EXAMPLE 13

A 12-μm-thick electrolytic copper foil was stuck on the surface of an insulating member having a thickness of 150 μm, a tensile strength of 1200 kg/cm$^2$ and a modulus of elasticity for bending of 5×10$^4$ kg/cm$^2$ prepared by compression-forming nylon 66 that is of a material of nylon 66 and containing 20% by weight of Kevler (Kevler long-fiber reinforced resin AC pellet-AISHIN KAKO Co.), through a 10-μm-thick epoxy adhesive layer. Then, a control electrode member was obtained by leaving a 1-mm-wide electrode member only on a tip portion of the insulating member mentioned above by means of etching. This control electrode member was installed in Konica 9028 wherein a developer layer regulating member was changed to a doctor blade which is represented by a gap of 125 μm from a developer conveyance roller, under the conditions of r=10 mm, $l_1$=9 mm, $l_2$=4 mm, d=1.5 mm, $\theta_5$=0°, $\theta_6$=30° and $\theta_7$=30°, all in FIGS. 23(*a*) and 23(*b*).

Photoreceptor surface potential on a white background portion was set to −850 V, D.C. voltage for a control electrode was set to −750 V, impressed D.C. voltage for a developer carrier (developing roller) was set to −750 V, frequency of A.C. bias voltage impressed between the developer carrier and the control electrode was set to 8 kHz and its voltage was set to 1.7 $kV_{p-p}$.

A developer that is exclusive for Konica 9028 was used without changing it except that $\sigma_{1000}$ of a developer carrier of the developer was changed from normal 18 emu/g to 25 emu/g. In the performance test, no deterioration of image quality was observed even after making 30,000 copies continuously.

As described above, the technology in which the plate-shaped elastic member is located in such a manner that it is pressed on the developer on the developer conveyance body, is an effective method for forming a uniform, especially a uniformly thin and high density developer layer.

When this plate-shaped elastic body is located in the developing area formed by the image forming body and the opposing developer conveyance body, or at the upstream side of the developing area with respect to the developer conveyance direction, then the developer layer conveyed to the developing area is uniform, thin and of high density.

When this plate-shaped elastic body is located, since the configuration of the developing unit, especially since the developing area is very narrow, it is difficult to locate a thick plate-shaped body using a large holding member having a complicated structure. Accordingly, it is more practical to locate a thin plate-shaped body by supporting one end of the plate-shaped body. Foe example, it is practical that one end of the plate-shaped elastic body, located on the upstream side with respect to the developer conveyance direction, is supported. In order to insert the plate-shaped elastic body, still leaving a margin, into the closest distance (normally, not larger than 1 mm) between the image forming body and the developer conveyance body in the developing area, it is preferable to have the thickness of the plate-shaped body be 20 through 500 μm.

As described above, when the plate-shaped electrode is adopted, accurate electrode installation can be realized.

Especially, when the method in which the plate-shaped electrode is located in such a manner that it is in pressure-contact with the developer on the developer conveyance body, is adopted, the electrode can be located accurately and easily. That is, when the control electrode member is composed of an insulation member which is in pressure-contact with the developer on the developer conveyance body, and an electrode member located outside the contact surface of the insulation member with the developer on the developer conveyance body; and this control electrode member is inserted into the developing area formed by the image forming body and the opposing developer conveyance body through the insulation member in such a manner that the control electrode member is in pressure-contact with the developer on the developer conveyance body, then the electrode can be accurately located in the developing space.

Further, a method, in which this control electrode member is located in such a manner that it is in pressure-contact with the image forming body, can also locate the electrode accurately. That is, when the control electrode member is composed of an insulation member which is in pressure-contact with the image forming body, and an electrode member located outside the contact surface of the insulation member with the image forming body; and this control electrode member is inserted into the developing area formed by the image forming body and the opposing developer conveyance body through the insulation member in such a manner that the control electrode member is in pressure-contact with the image forming body, then the electrode can be accurately located in a developing space.

When this plate-shaped electrode is located, since the configuration of the developing unit, especially since the developing area is very narrow, it is difficult to locate a thick plate-shaped body using a large holding member having a complicated structure. Accordingly, it is more practical to locate a thin plate-shaped body by supporting one end of the plate-shaped body. Foe example, it is practical that one end of the electrode made of the plate-shaped elastic body, located on the upstream side with respect to the developer conveyance direction, or located on the upstream side or the downstream side with respect to the rotational direction of the image forming body, is supported. In order to insert the control electrode member, leaving a margin, into the developing space, that is, the closest distance (normally, not larger than 1 mm) between the image forming body and the developer conveyance body in the developing area, and further, in order to strengthen the electric field formed between the control electrode and the developer conveyance body so that the developer is effectively separated and flies from the developer conveyance body, it is preferable to set the thickness of the control electrode member to 20 through 500 μm.

Such a thin member as the smoothing member or control electrode member has inevitably low elasticity. For example, when only one end is supported, the member can not be stably located, and it is difficult that a uniformly thin and high density developer layer is formed. There is also a larger problem: in the case where the member is located in such a manner that it is in pressure-contact with the developer conveyance body or the image forming body, the member is abraded when the pressure-contact is continued over a long period of time; and further the pressing force is decreased due to the permanent deformation caused by the abrasion. When the pressure-contact portion is abraded and the pressing force is decreased, the developer smoothing effect is changed and the relative position of the electrode member in the developing area is changed, so that the operation of the developing unit becomes unstable.

An object of the present invention is to realize that a developer smoothing member installed to be in pressure-contact with developer on a developer conveyance body can be installed and operated stably, namely formation of a uniform and thin developer layer with high density can be achieved for a long time, and another object is to realize that a control electrode member installed to be in pressure-contact with developer on the developer conveyance body or with an image forming body can be installed and operated stably, namely, high image density and low background density both are uniform (which appears as color mixing development in the case of non-contact multi-layer development) can be achieved for a long time. To be concrete, a smoothing member and a control electrode member both are made of a resin member reinforced with inorganic fibers or organic fibers which have a tensile strength and a modulus of elasticity for bending both are higher than a fixed value can provide an excellent developer smoothing member and an excellent control electrode member as well as a developing method employing both the developer smoothing member and the control electrode member all satisfying the objects of the invention mentioned above.

The smoothing member and the developing method employing the same can increase stably for a long time the uniformity and density of the developer that is on the developer conveyance body to be conveyed. As a result, images with high sharpness can be obtained stably for a long time.

The control electrode member mentioned above and the developing method employing the same can supply sufficient developer to the developing area, and they can further cause the supplied developer to fly and adhere to the latent image on the surface of the image forming body at a high efficiency. For the background area where adhesion of developer is not desired, clear images which are free from adhesion of developer can be obtained stably for a long time.

The structure of a developer smoothing member by which the second object of the present invention is attained, will be described bellow.

The second object of the present invention can be attained by a developer smoothing member for a developing unit made of resins reinforced with inorganic fibers or organic fibers, which is provided to be in pressure-contact with a developing agent on a developer conveyance body at the developing area surrounded by an image forming body and by a developer conveyance body which faces the image forming body or at the position located on the upstream side of the developer conveyance body in the developer conveyance direction. The object of the invention mentioned above can be achieved by this developer smoothing member.

The second object of the present invention is represented by a control electrode member for a developing unit wherein the insulating member is made of resins reinforced with inorganic fibers or organic fibers, which is provided to be in pressure-contact with a developing agent on a developer conveyance body at the developing area surrounded by an image forming body and by a developer conveyance body which faces the image forming body or at the position located on the upstream side of the developer conveyance body in the developer conveyance direction. The object of the invention mentioned above can be achieved by this control electrode member.

The second object of the present invention is represented by a control electrode member for a developing unit wherein the insulating member is made of resins reinforced with inorganic fibers or organic fibers, which is provided to be in pressure-contact with an image forming body at the developing area surrounded by an image forming body and by a developer conveyance body which faces the image forming body or at the position located on the upstream side or the downstream side of the image forming body in the direction of the rotation of the image forming body. The object of the invention mentioned above can be achieved by this control electrode member.

The second object of the present invention is represented by a developing method wherein a smoothing member made of resins reinforced with inorganic fibers or organic fibers is installed so that one end of the smoothing member may be affixed at the position located at the upstream side of a developing space (namely, a developing area) where development is mainly carried out in the direction of developer conveyance made by a developer conveyance body, and the other end may be brought into pressure-contact with a developer on the developer conveyance body, pointing to the downstream side to be positioned within the developing area or at the upstream side of the developing area. The object of the invention mentioned above can be achieved by this method.

The second object of the present invention is represented by a developing method wherein a control electrode member composed of an insulating member made of resins reinforced with inorganic fibers or organic fibers and an electrode member provided on the insulating member is installed so that one end of the smoothing member may be affixed at the position located at the upstream side of a developing space (namely, a developing area) where development is mainly carried out in the direction of developer conveyance made by a developer conveyance body, and the other end may be brought into pressure-contact with a developer on the developer conveyance body, pointing to the downstream side to be positioned within the developing area. The object of the invention mentioned above can be achieved by this method.

The second object of the present invention is represented by a developing method wherein a control electrode member composed of an insulating member made of resins reinforced with inorganic fibers or organic fibers and an electrode member provided on the insulating member is installed so that one end of the smoothing member may be affixed at the position located at the upstream or downstream side of a developing space (namely, a developing area) where development is mainly carried out in the direction of the rotation of an image forming body, and the other end may be brought into pressure-contact with the image forming body, pointing to the downstream or upstream side to be positioned within the developing area. The object of the invention mentioned above can be achieved by this method.

In the present invention, a developer smoothing member installed to be in pressure-contact with developer on a developer conveyance body can be installed and operated stably, namely formation of a uniform and thin developer layer with high density can be realized for a long time, and further, a control electrode member installed to be in pressure-contact with developer on the developer conveyance body or with an image-forming body can be installed and operated stably, namely, high image density and low image density both are uniform (which appears as color mixing development in the case of non-contact multi-layer development) can be realized for a long time.

Namely, a smoothing member and a control electrode member both are made of a resin member reinforced with inorganic fibers or organic fibers which have a tensile strength and a modulus of elasticity for bending both are higher than a fixed value can provide an excellent developer smoothing member and an excellent control electrode member as well as a developing method employing both the developer smoothing member and the control electrode member all satisfying the objects mentioned above.

The smoothing member and the developing method employing the same can increase stably for a long time the uniformity and density of the developer that is on the developer conveyance body to be conveyed. As a result, images with high sharpness can be obtained stably for a long time.

The control electrode member mentioned above and the developing method employing the same can supply sufficient developer to the developing area, and they can further cause the supplied developer to fly and adhere to the latent image on the surface of the image forming body at a high efficiency. For the background area where adhesion of developer is not desired, clear images which are free from adhesion of developer can be obtained stably for a long time.

What is claimed is:

1. A developing apparatus for developing an electrostatic latent image formed on an image retainer with a two-component developer containing magnetic particles and toner, the developing apparatus comprising:

a rotatable sleeve having a rotation center, wherein the sleeve disposed to face the image retainer, for conveying the two component developer to a developing region which is formed between the rotatable sleeve and the image retainer, and wherein the sleeve has a closest position on which the sleeve comes closest to the image retainer, a first magnet fixed in the sleeve in close proximity to the closest position, a second magnet disposed upstream of the first magnet in relation to a rotation direction of the sleeve and fixed in the sleeve, the second magnet having a polarity opposite to that of the first magnet so that the magnetic particles are attracted so as to convey the two component developer on the sleeve between the first and second magnets, and a control electrode member including:

an insulating plate member arranged either to be brought into contact with or to be positioned adjacent to the sleeve, and positioned between the first and second magnets, and a line-shaped electrode member fixed to the plate member so that the line-shaped electrode member is positioned exclusively downstream of a position where the plate member is in contact with or closest to the sleeve in relation to the conveying direction of the developer.

2. The apparatus of claim 1, wherein the first magnet is disposed with an angle $\theta_1$ of $-10°$ to $+10°$ from the closest position around the rotation center of the sleeve, and wherein "–" represents a downstream side of the closest position and "+" represents an upstream side of the closest position.

3. The apparatus of claim 2, wherein the angle $\theta_1$ is $-5°$ to $+5°$.

4. The apparatus of claim 1, wherein the first magnet is disposed at an upstream side of the closest position.

5. The apparatus of claim 1, wherein an angle $\theta_3$ between the first and second magnets around the rotation center of the sleeve is $+10°$ to $+45°$.

6. The apparatus of claim 5, wherein an angle $\theta_2$ between the first magnet and the control electrode member is 0° to $0.5\times\theta_3$.

7. The apparatus of claim 1, further comprising a third magnet provides in the sleeve at a downstream side of the closest position, and wherein an angle $\theta_4$ between the first and third magnets around the rotation center of the sleeve is 10° to 45°.

8. The apparatus of claim 1, wherein, when a magnetic flux density of the first magnet in a radial direction of the sleeve is Hr, a magnetic flux density of a position of the line-shaped electrode member is 0.2×Hr to Hr.

9. The apparatus of claim 1, wherein the plate member is made of a resin which is reinforces by one of an organic fiber and an inorganic fiber.

10. The apparatus of claim 9, wherein the resin is a thermoplastic resin.

11. The apparatus of claim 9, wherein the resin is a thermosetting resin.

12. The apparatus of claim 9, wherein the reinforced resin has a tensile strength not less than $8\times10^2$ kg/cm$^2$ and a modulus of elasticity for bending not less than $5\times10^4$ kg/cm$^2$.

13. The apparatus of claim 9, wherein the plate member has a thickness of 20 μm to 200 μm and a length of 5 mm to 50 mm in a developer-conveying direction.

14. A developer smoothing member for a developing unit, wherein:

said developer smoothing member is located on an upstream side of a developing area or on an upstream side with respect to a developer conveyance direction of a developer conveyance body, said developer smoothing member is in pressure-contact with a developer on the developer conveyance body, and said developer smoothing member is made of a resin reinforced with inorganic or organic fiber the resin reinforced with inorganic or organic fiber having a tensile strength of more than $8\times10^2$ kg/cm$_2$ and a modulus of elasticity for bending of more than $5\times10_4$ kg/cm$_2$.

15. The developer smoothing member according to claim 14, wherein the resin reinforced with inorganic or organic fiber is a thermoplastic resin.

16. The developer smoothing member according to claim 14, wherein the resin reinforced with inorganic or organic fiber is a thermosetting resin.

17. The developer smoothing member according to claim 14, wherein the developer smoothing member has a thickness of 20 to 200 μm, and a length in the developer conveyance direction of 5 to 50 mm.

18. A control electrode member for a developing unit comprising:

an insulation member which is in pressure-contact with an image forming body, the insulation member being located on one of (i) an upstream side or a downstream side of a developing area, or (ii) on an upstream side or a downstream side with respect to a rotational direction of the image forming body, and an electrode member attached to the insulation member, and wherein the insulation member is made of resin reinforced with inorganic or organic fiber.

* * * * *